US009540887B2

(12) United States Patent
Ditillo et al.

(10) Patent No.: US 9,540,887 B2
(45) Date of Patent: Jan. 10, 2017

(54) AUGER CLEANING DEVICE FOR REMOVING DEBRIS FROM A HELICAL DRILLING TOOL, DRILLING MACHINE PROVIDED WITH SAID CLEANING DEVICE AND USE OF SAID DRILLING MACHINE

(71) Applicant: SOILMEC S.p.A., Cesena (FC) (IT)

(72) Inventors: Alessandro Ditillo, Cesena (IT); Claudio Benzi, Castiglione di Ravenna (IT)

(73) Assignee: SOILMEC S.P.A., Cesena (FC) (IT)

( * ) Notice: Subject to any disclaimer, the term of this patent is extended or adjusted under 35 U.S.C. 154(b) by 188 days.

(21) Appl. No.: 14/138,307

(22) Filed: Dec. 23, 2013

(65) Prior Publication Data

US 2015/0176337 A1 Jun. 25, 2015

(30) Foreign Application Priority Data

Dec. 28, 2012 (IT) ..... MI2012A2264

(51) Int. Cl.
*E21B 12/06* (2006.01)

(52) U.S. Cl.
CPC ..... *E21B 12/06* (2013.01)

(58) Field of Classification Search
CPC ..... E21B 10/44; E21B 12/06
See application file for complete search history.

(56) References Cited

U.S. PATENT DOCUMENTS 4,650,012 A * 3/1987 Bollinger ..... E21B 12/06 15/104.04
6,017,180 A * 1/2000 Wilham ..... B65G 65/4836 406/90
7,614,463 B1 * 11/2009 Hunziker ..... E21B 12/06 15/256.53
2005/0161237 A1 7/2005 Manor

FOREIGN PATENT DOCUMENTS

DE 34 46 902 A1 7/1986
JP 60-169386 U 11/1985
JP 7-324581 A 12/1995
JP 2004-84161 A 3/2004
SU 726303 A1 4/1980

OTHER PUBLICATIONS

Italian Search Report of MI20122264 dated Aug. 27, 2013.

* cited by examiner

*Primary Examiner* — David Andrews
(74) *Attorney, Agent, or Firm* — Lucas & Mercanti, LLP

(57) ABSTRACT

In the auger cleaning device (8) according to the invention, in the closed configuration the tool-holder support forms a pass-through opening (82) arranged for allowing the passage of a helical drilling tool (6), the cleaning tool (170) engaging with the screw of the drilling tool (6) and, actuated by the actuation system (12, 12',12", 4), is arranged for rotating around the drilling tool (6) following at least one of its threads (60) so as to remove the debris lying on the drilling tool (6). In the open configuration the cleaning tool (170) is disengaged from the drilling tool (6) and preferably farther from it, with respect to when it is in the closed configuration.

15 Claims, 18 Drawing Sheets

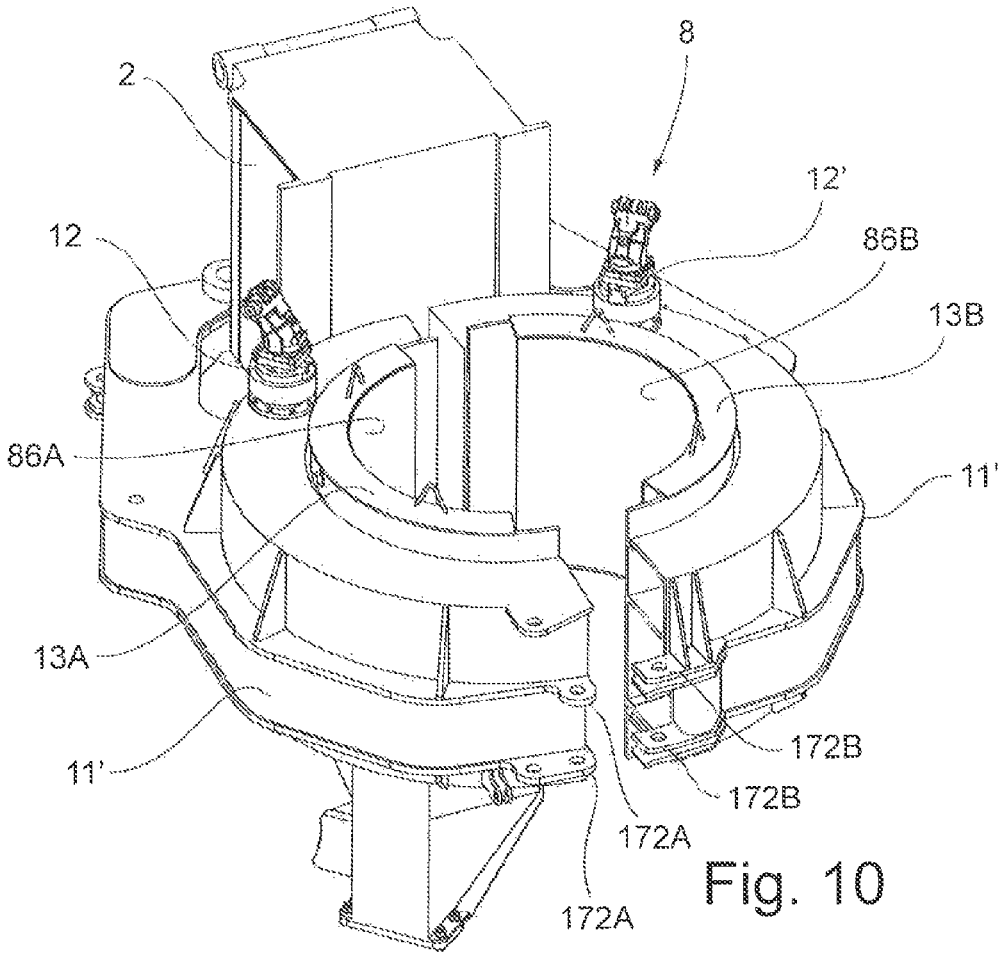
Fig. 10
Fig. 10A
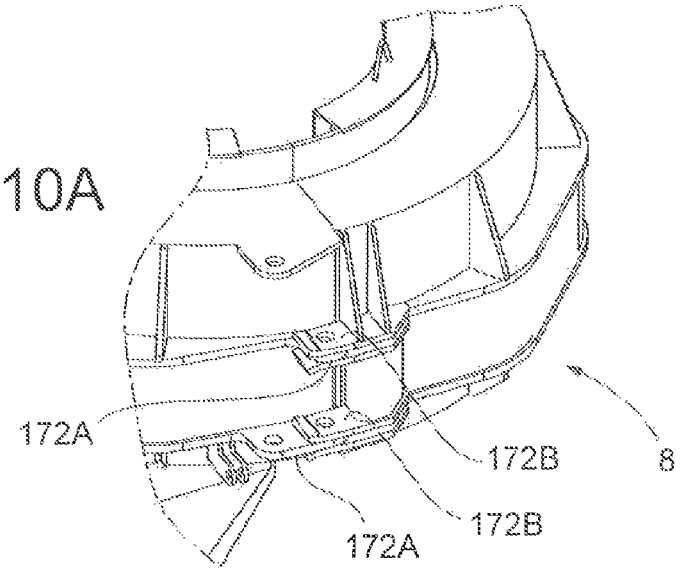

AUGER CLEANING DEVICE FOR REMOVING DEBRIS FROM A HELICAL DRILLING TOOL, DRILLING MACHINE PROVIDED WITH SAID CLEANING DEVICE AND USE OF SAID DRILLING MACHINE

FIELD OF THE INVENTION

The present invention concerns an auger cleaning device for removing debris from a helical tool used for drilling ground, a drilling machine provided with such a cleaning device and a use of such a machine.

The present application claims the priority of the Italian patent application n° MI2012A002264, the content of which is incorporated herein by reference.

STATE OF THE ART

In the field of drilling in order to make piles having a large diameter a large part of the foundations are made with auger technology—or rather—with a continuous screw, better known as CFA (Continuous Flight Auger). This method performs well when it is necessary to drill holes with a medium-small diameter, in cohesive ground but also in incoherent ground or in general in ground with a high possibility of collapsing inside the hole that is being made. A rotary table that is located on the guides of a vertical tower pushes an auger inside the hole having a length that can be compared to that of the tower itself. The depths do not normally exceed 35 meters, both due to the fact that the length of the auger is proportional to that of the tower and this implies a machine size that is increasingly greater, with difficulties in terms of transportation and having high costs, and due to the fact that the auger full of earth has a weight such as to require a considerable extraction force (and multiple) that is increasingly greater. The auger, equipped with teeth in the lower part, provides for drilling, for supporting, with its presence, the walls of the well that is being made and for expelling the debris rising along the inclined plane of the auger thanks to the rotation movement and by the helical profile thereof.

This method makes it possible dry machining, i.e. without using stabilising fluids for supporting the walls of the hole, and without vibrations. These two characteristics make CFA technology particularly suitable for its use in residential areas, where the construction sites have a small area and do not allow there to be treatment plants and plants for the recirculation of stabilising fluids (polymers, bentonite). The debris that has reached above the natural surface line, no longer constrained in the cylindrical section of the hole, if dry or granular, can find a way outside and cascade around the foot of the tower from which they can be removed through wheeled/tracked vehicles while carrying out the drilling. On the other hand, in the case of cohesive ground, the extracted ground remains stuck against the surface of the auger and must be mechanically removed so as to prevent it from suddenly falling from very high heights.

The types of ground passed through during drilling is however much greater and the dry and granular debris represent a minimum part of what can generally be expected as material resulting from digging. Often the auger rises full of humid clays that are so compact as to be able to hide the turns of the auger itself. At the end of the drilling, the auger ensures addition of cement mixture, which is pumped through the hollow core of the auger itself. The mixture, normally concrete, comes out from the bit and fills the space that the auger frees up as it is pulled upwards. In this step, the auger is lifted avoiding any rotation movement and at most it keeps the same rotation movement that it took up during the drilling. The purpose of these maneuvers is that of preventing the debris present on the auger from being able to fall in the rising mass of concrete and pollute its properties. In both cases, however, it is necessary to manage an auger that is full of debris which, only in some cases, falls from the turns on its own and naturally. In most cases, the auger must be cleaned in the moment in which it raises and comes out from the hole made in the ground. It is strongly recommended to use means that can clean the auger during its lifting so as to protect the physical integrity of the workers that are asked to carry out many supporting activities in the immediate vicinity of the auger, when this is totally extracted from the hole. Among these activities it is worth listing: installation of the cage, maintenance of the bit, e.g. for the replacement of the teeth, closure of the door for expelling concrete, when it is necessary due to the particular shape. It is not permissible for the workers to move below an auger that is even more than 35 meters high with the threat of falling debris (not only blocks of clay but also gravel, pebbles or small masses of rocks and ground) with a considerable weight and which fill the turns. The fall can be caused both by the rotation and in some cases by the simple axial extraction movement of the auger or by the vibrations generated on the auger due to small shaking or jerking movements. The auger needs therefore, be necessarily always cleaned, especially in large diameter piles (800-1500 mm), in which the wing represented by the turn can receive masses of several tens of kilos. For this reason devices that are suitable for such a purpose, generically called auger cleaners provide for freeing up the turns from any material that has been deposited during the drilling.

Indicatively, these devices can be divided into two categories.

First Category

Those mounted along the tower, generally in a fixed non-sliding position and that have an arm that is equipped with means that are suitable for cleaning the auger. The arm is usually moved hydraulically and displaces the cleaning means out and inside the circumference represented by the external diameter of the auger. For their shape, when these devices are retracted (open) in an external position outside the auger, they allow the passage of the rotary table—also called "rotary" in the current technical jargon—in front of them and thus have the very valued specialty of not getting in the way of the stroke of the rotary along the guides of the tower. The use of such devices does not therefore involve a decrease in the depth of the pile. On the other hand, the effectiveness of their cleaning action is only partial and requires the auger to be set in rotation during the extraction so as to allow a more complete cleaning. The rotation however generates problems when carrying out the casting and is not always admissible.

Second Category

Those mounted around the auger itself, normally sliding along the tower, more rarely fixed above or straight below the rotary (e.g. in the cases of cased auger drilling). Devices of this second type have a vertical cylinder with a diameter that is greater than the auger, passed through it, and that can act as a containment element of the auger itself, conventionally called "static part" because it does not rotate. This cylinder is usually made up of a monolithic structure and it is usually provided with shoes that can slide along the guides of the tower, preferably the same on which the trolley of the rotary slides. Said cylinder equipped with shoes thus constitutes a second trolley, which occupies a linear section of the guides that cannot be exploited by the trolley of the rotary. In the lower part of said cylinder a slew ring is fixed below which there is the "rotating part" of the system. The rotating part is substantially a ring with a small height on which, in a radial position one or more mechanical means that are suitable for cleaning are mounted, e.g., rollers or blades. A geared motor mounted on the static part presses on the external toothed surface of the slew ring (bearing with a large diameter that in rotation releases the rotating part with respect to the fixed part, allowing it to be guided and allowing the workloads to be transferred) and sets in rotation the rotating part, typically the lower part. The roller(s) is(are) rested on the upper face of the turns of the auger. If the auger is set in rotation when it rises up, the cleaner rises back along the turns. When it is desired to clean the turns, the rotation of the auger stops and the geared motor of the cleaner is actuated. This actuates the rotating part that starts turning around the axis of the auger, in the rotation direction in accordance with the auger itself (the auger is generally right-handed, i.e. it penetrates the ground with a clockwise direction, therefore the rotating part for being lowered is also set in a clockwise direction) the rollers thus descend along the slant of the turn and with their mechanical rigidity and strength, provide for removing the material that they encounter along the trajectory. Typically, the roller penetrates the plane of the auger reaching the central tube so as to be able to clear all the space of the auger. The effectiveness of this type of device is commonly recognised but it has the drawback of reducing the stroke of the rotary along the tower and consequently the drilling depth, by a measurement that is equal to its bulk in height. The depth that is lost with the use of this device can be quantified in the order of 1.5-2 m.

In the first group there is the cleaner of document U.S. Pat. No. 7,614,463B1 in which two mechanical arms, which are hinged to the tower are manually placed in contact with the core of the auger. The two elements are mounted staggered with respect to the vertical so as to each be located in the gap between two turns, in the point in which there is the debris. A spring keeps the two arms pressed on the core of the auger facilitating the cleaning of the turns. The system is manual, and can be applied only to augers having small diameters (100-200 mm) and requires the rotation of the auger in order for it to be cleaned.

Document JP62284888A provides for the insertion of a shaped roller in the circumference represented by the disc of the auger. In brief, the roller has the appearance of a counter-auger and is actuated by a hydraulic cylinder that arranges the position from working to resting. In the resting position, like in the previously mentioned patent, the system comes out from the bulk of the disc of the auger. The cleaner has in its lower part a hopper acting as a conveyor for deviating the debris in a precise falling direction. The counter-auger may not be motorised, and in this case it would be pulled, in its rotary movement, from the rotation of the turns of the auger itself. Just like in the previous patent, this one requires the rotation of the auger in order for it to be cleaned.

Document JP2004084161A is located between the first and the second group. It is mounted on guides that can slide on the tower, it consists of two parts that embrace the auger but the cleaning elements (brushes in this case) are static with respect to the structure of the cleaner. This means that in order to clean the auger, this must be set in rotation, or even better in counter-rotation with respect to the drilling direction and therefore without a provision for blocking the fall, the debris tends to drop in the hole obtained, jeopardising the qualities of the cast of concrete that at the end will have inclusions of ground in it.

In the second group there is document EP0744525B1. This cleaning system is the typical example of cleaners of the second group and relies on gravity. It is not motorised and it consists of a drum sliding along the tower, inside which the auger transits. The drum mounts in its lower part a rotation slew ring. Under the slew ring two opposite rollers are mounted with a radial axis, rotating as a unit with the slew ring and resting on the turn of the auger. When the auger is full, the cleaner is released from its resting position and, due to its weight, it tends to slide along the downward turn of the auger, removing, by means of its rollers, the ground deposited between the turns. The effectiveness of such a device depends upon the nature of the debris, upon the amount and upon the weight of the system itself. In the presence of a substantial volume of particularly cohesive debris, the system may not have enough potential energy for cleaning the auger. In some cases it is required for there to be the axial block of the cleaner with respect to the tower so as to best counteract the forces of the ground and in this case its position is positioned above the lower guides present on the mast and the lost drilling height can reach up to 5 m. Moreover, since this system does not have the possibility of staying in background with respect to the disc of the auger, it occupies part of the height of the auger itself and consequently reduces the depth of the drilling.

One purpose of the present invention is to avoid the drawbacks mentioned above of the state of the art and in particular to provide an auger cleaner that offers the advantages of known auger cleaners of both the first and second category, and in particular does not require necessarily making the auger rotate on itself during the final casting and extraction steps, and at the same time does not reduce, or reduces to a lesser extent, the useful length of the auger.

SUMMARY OF THE INVENTION

Such a purpose is achieved, according to the present invention, with an auger cleaning device having the characteristics according to claim 1.

In one particular embodiment of the invention, the cleaning tool comprises one or more of the following elements:

- a roller arranged for rotating on itself on the at least one thread of the screw of the drilling tool and/or around a radial axis with respect to the screw of the drilling tool;
- a blade or plough that are arranged for sliding along the at least one thread of the screw of the drilling tool.

In a second aspect of the invention, such a purpose is achieved with a drilling machine having the characteristics according to claim 12.

In a third aspect of the invention, such a purpose is achieved with a use of the aforementioned drilling machine having the characteristics according to claim 14.

In a fourth aspect of the invention, such a purpose is achieved with a use of the aforementioned drilling machine having the characteristics according to claim 15.

In one particular embodiment, a machine having the characteristics according to claim 6 is used by controlling the operations provided by claims 14 and/or 15 through a control unit that enables the rotation of the cleaning tool when the two jaws are closed;

in such a case the control unit can enable the opening of the two jaws when the rotating parts (31, 13, 13') face the corresponding fixed parts (11, 11', 80'A, 80'B).

Further features of the device are object of the dependent claims. The advantages that can be achieved with the present invention shall become clearer, to the man skilled in the art, from the following detailed description of some particular non limiting embodiments, illustrated with reference to the flowing schematic figures.

LIST OF THE FIGURES

Figure 2A:
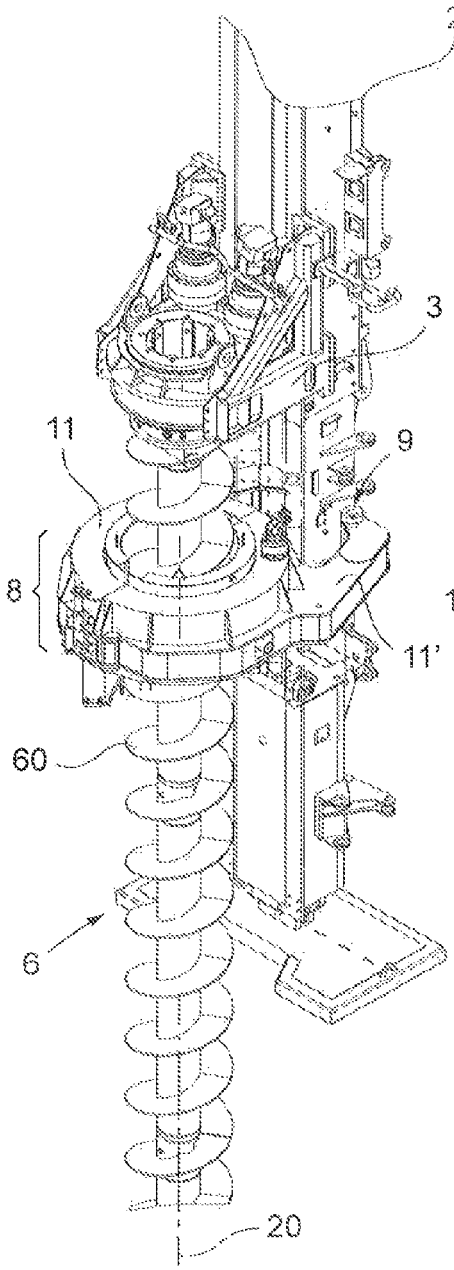
FIGS. 2A, 2B show two perspective views of the auger cleaning device of the drilling machine of FIG. 1, in the closed and open position, respectively.
Figure 5A:
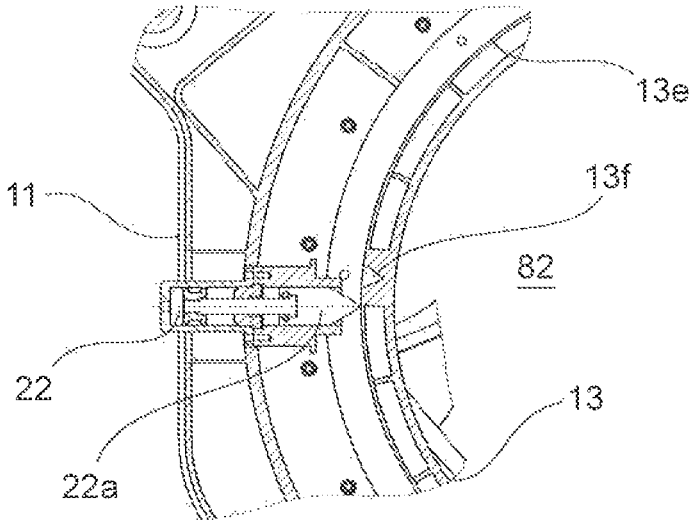
Figure 5B:
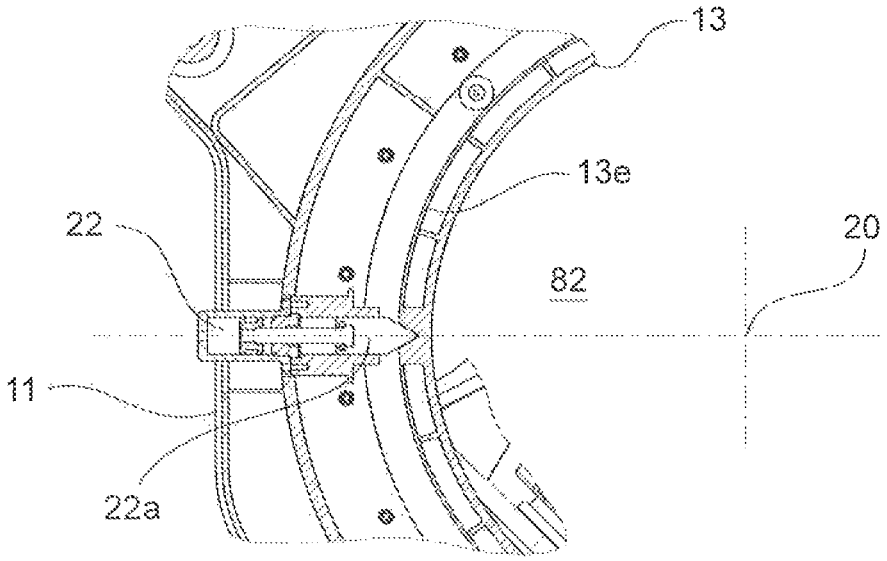
Figure 6A:
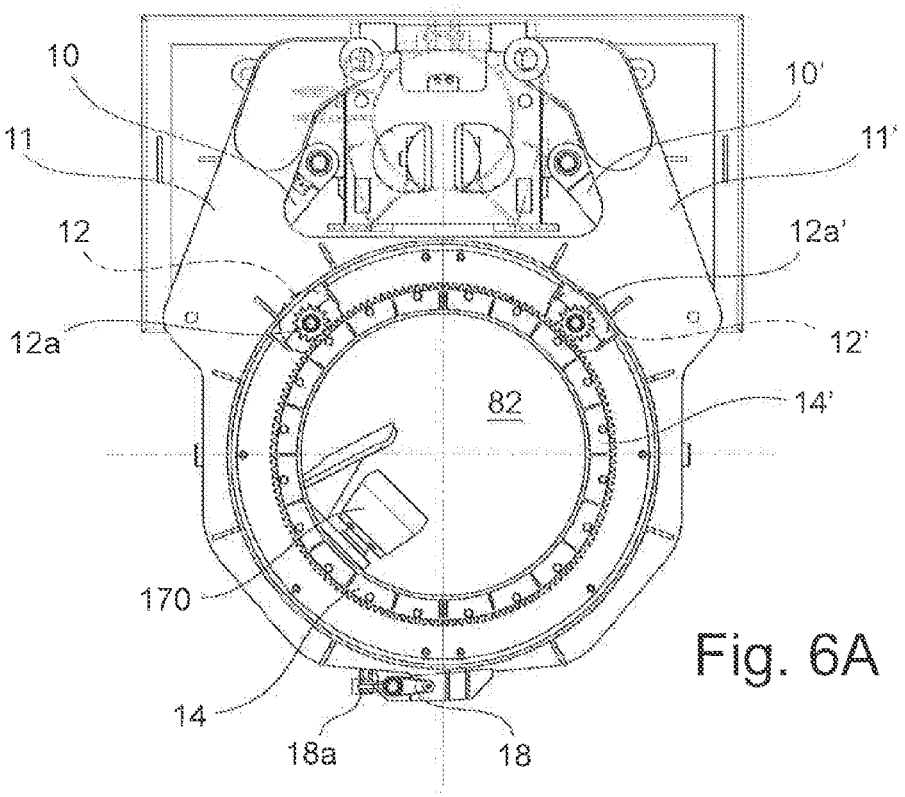
Figure 6B:
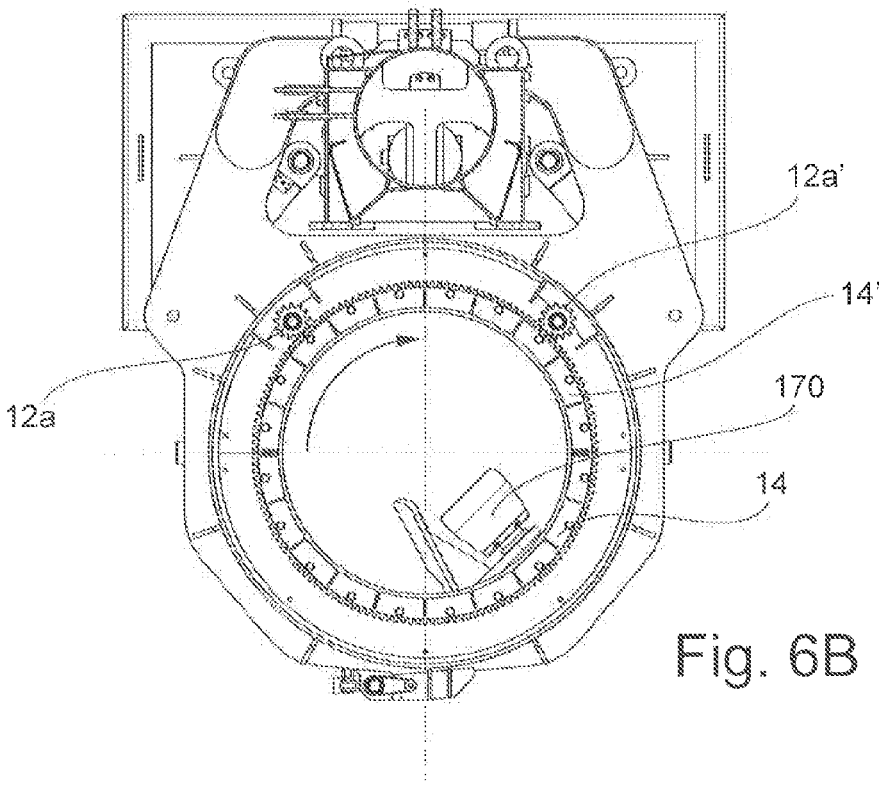
Figure 7:
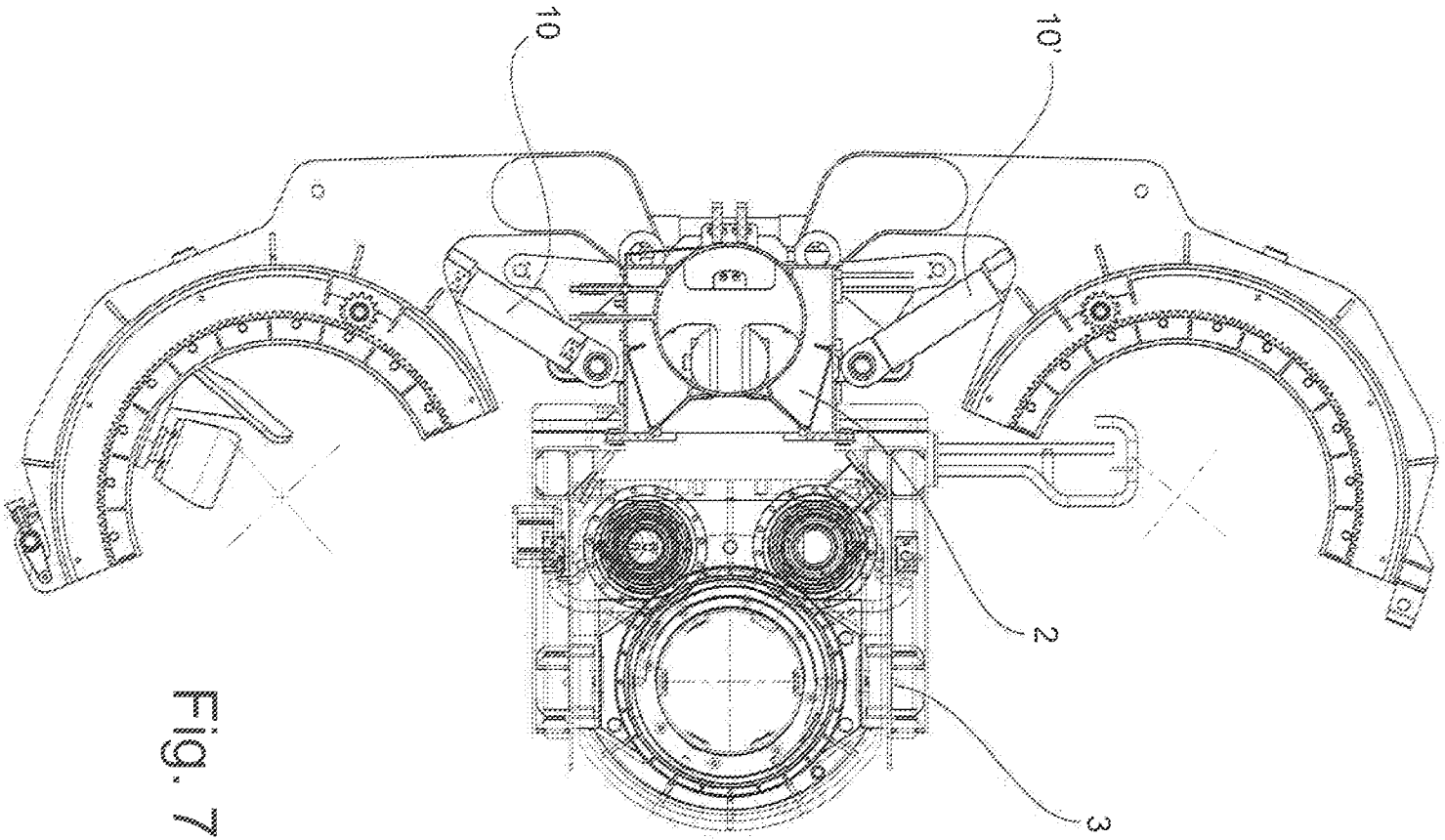
Figure 8:
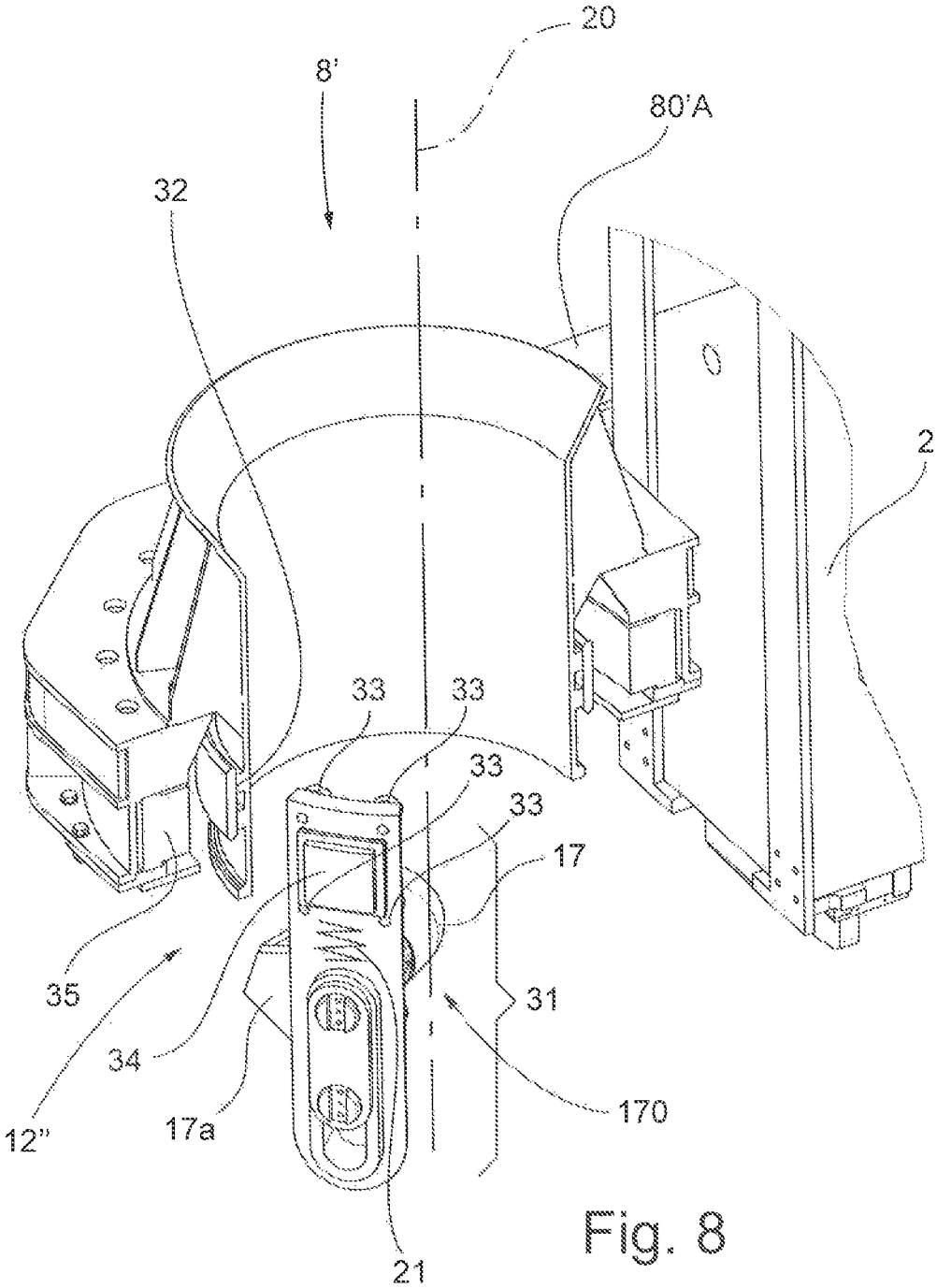
Figure 8A:
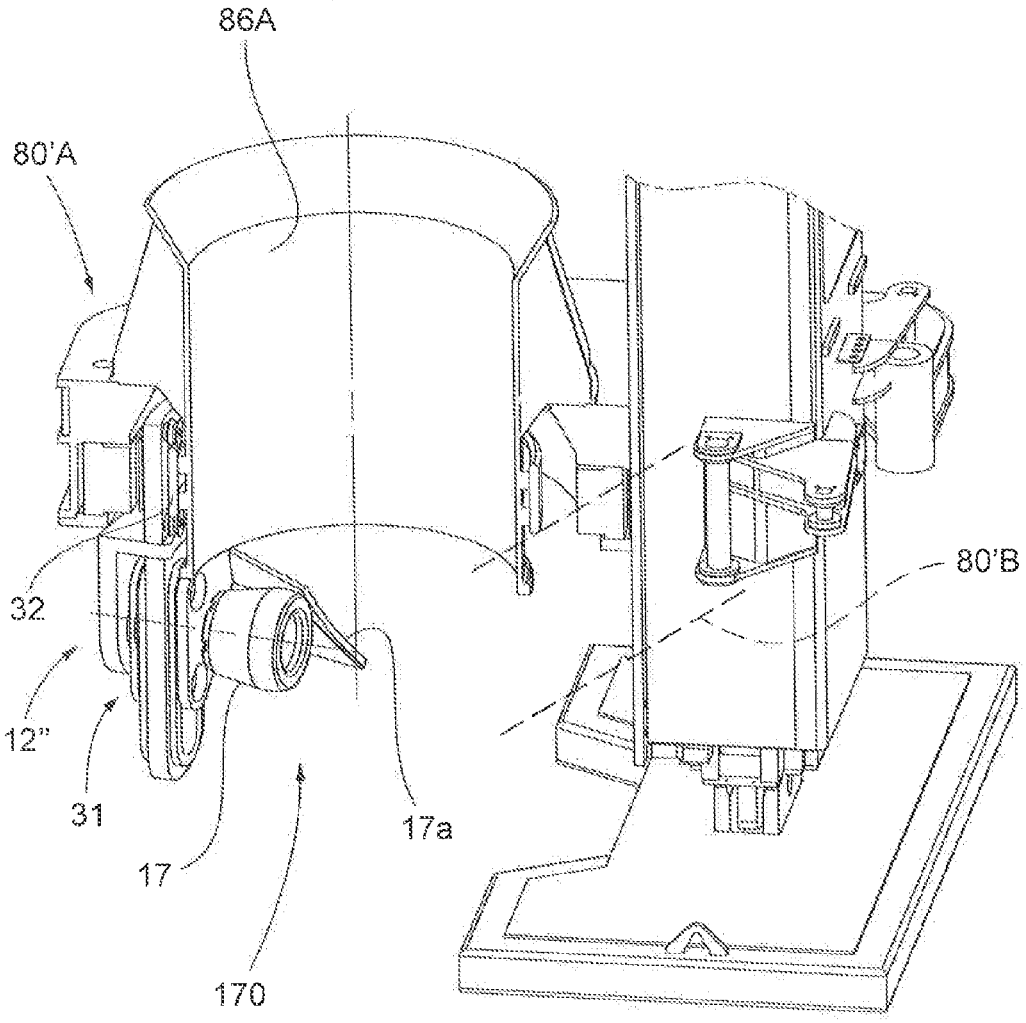
Figure 9:
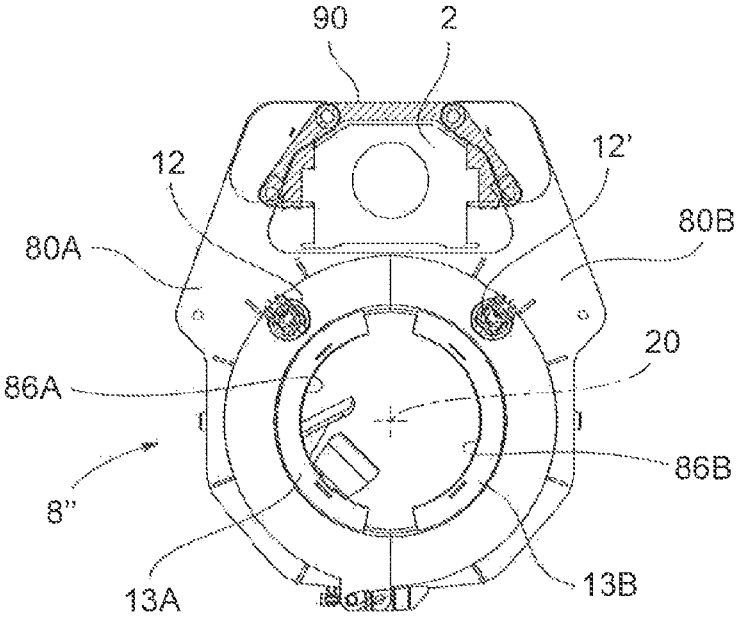
Figure 9A:
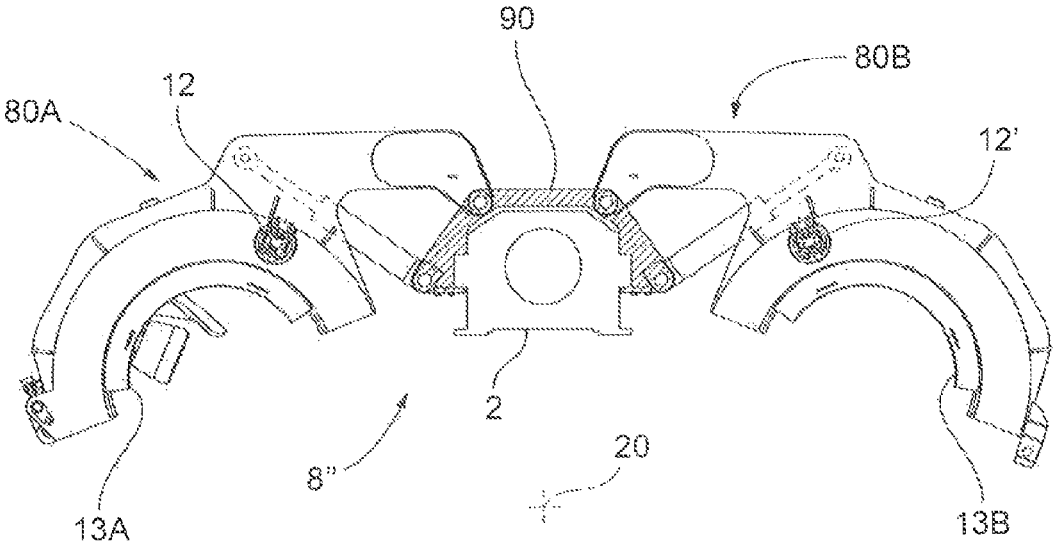
Figure 11:
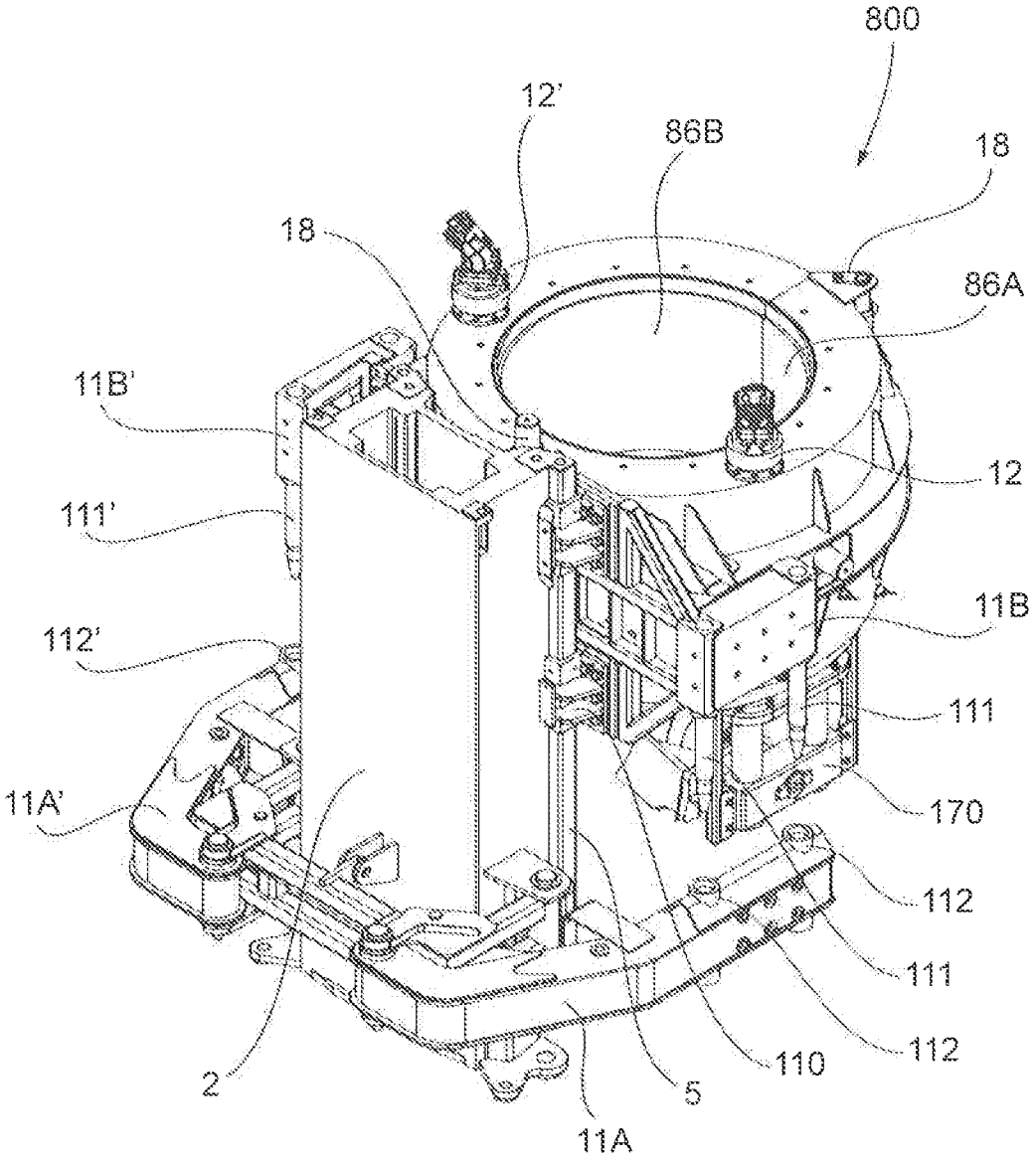
Figure 12:
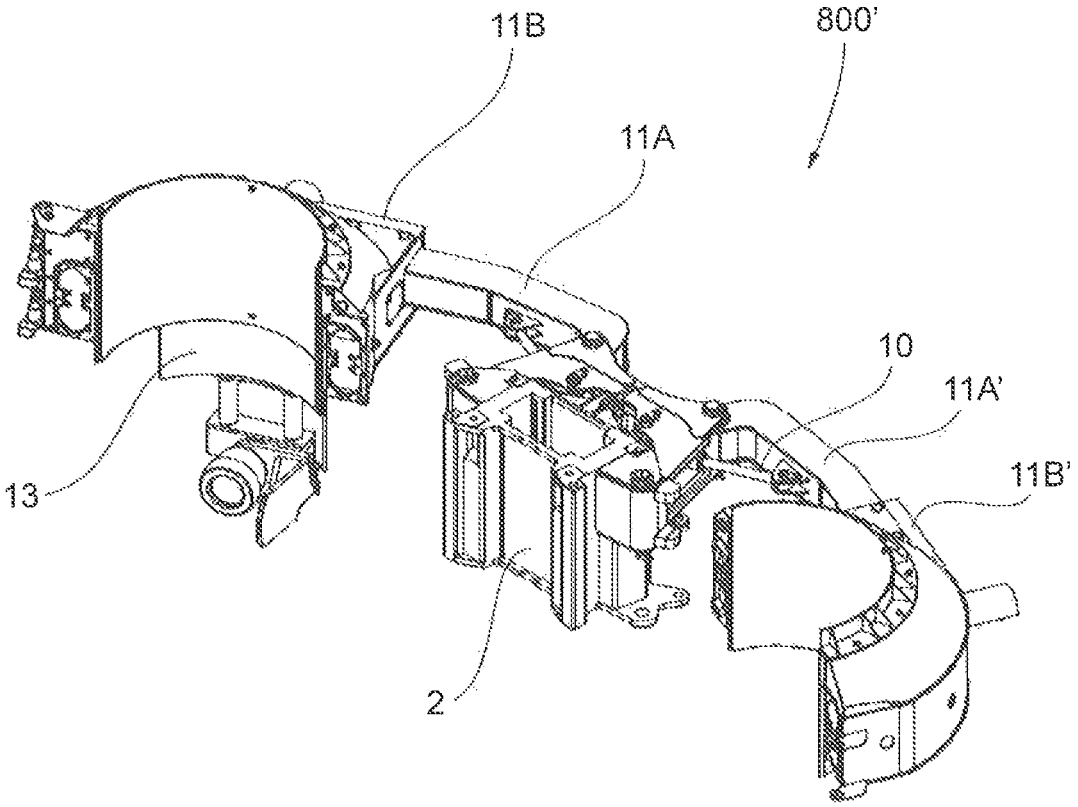
Figure 13:
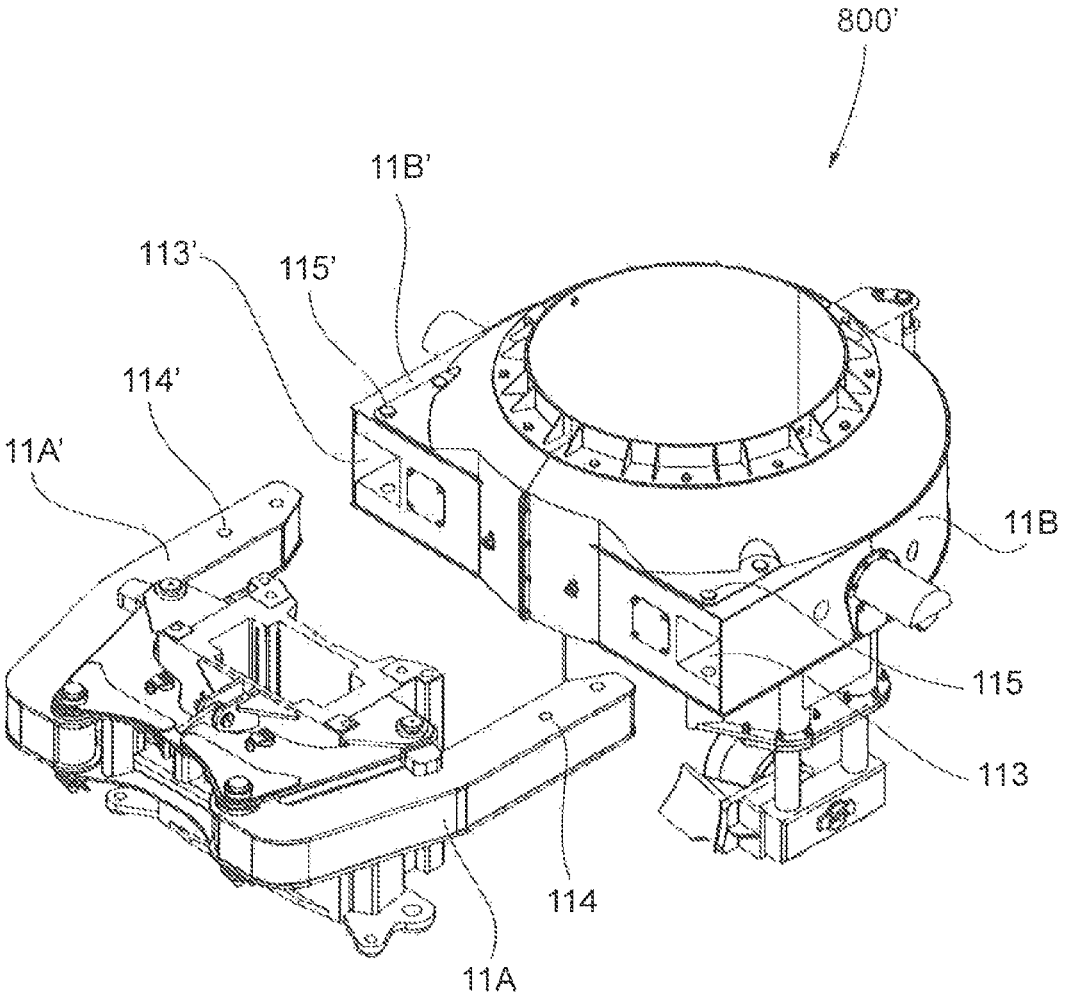

FIGS. 5A, 5B each show a top view, partially in section, of a detail of a jaw of the cleaner of FIG. 2A, according to a direction of observation that is parallel to the rotation axis of the drilling screw, respectively in the blocking and released conditions of the rotation of the relative perimetral wall;

FIGS. 6A, 6B both show a top view of the closed cleaner of FIG. 2A, according to a direction of observation that is parallel to the rotation axis of the drilling screw;

FIG. 7 shows a top view of the open cleaner of FIG. 2A, according to the same direction of observation as in FIGS. 6A, 6B;

FIGS. 8, 8A show two perspective views of a jaw of a cleaning device according to a second embodiment of the invention, with motors with permanent magnets;

FIGS. 9, 9A show two further views from above, and partially in section, of a cleaner according to a third embodiment of the invention, respectively closed and open, according to a direction of observation that is parallel to the axis of rotation of the drilling screw;

FIG. 10 shows a perspective view of the cleaner of FIG. 2A, partially closed;

FIG. 10A shows a perspective view with a detail of the cleaner of FIG. 10 in the closed position;

FIG. 11 shows a perspective view of a cleaning device 800 according to a fourth embodiment of the invention;

FIG. 12 shows a perspective view of a cleaning device 800' according to a fifth embodiment of the invention, in the open position;

FIG. 13 shows a perspective view of the cleaning device of FIG. 12, in a condition with the parts of the jaws released from one another.

Figure 14:
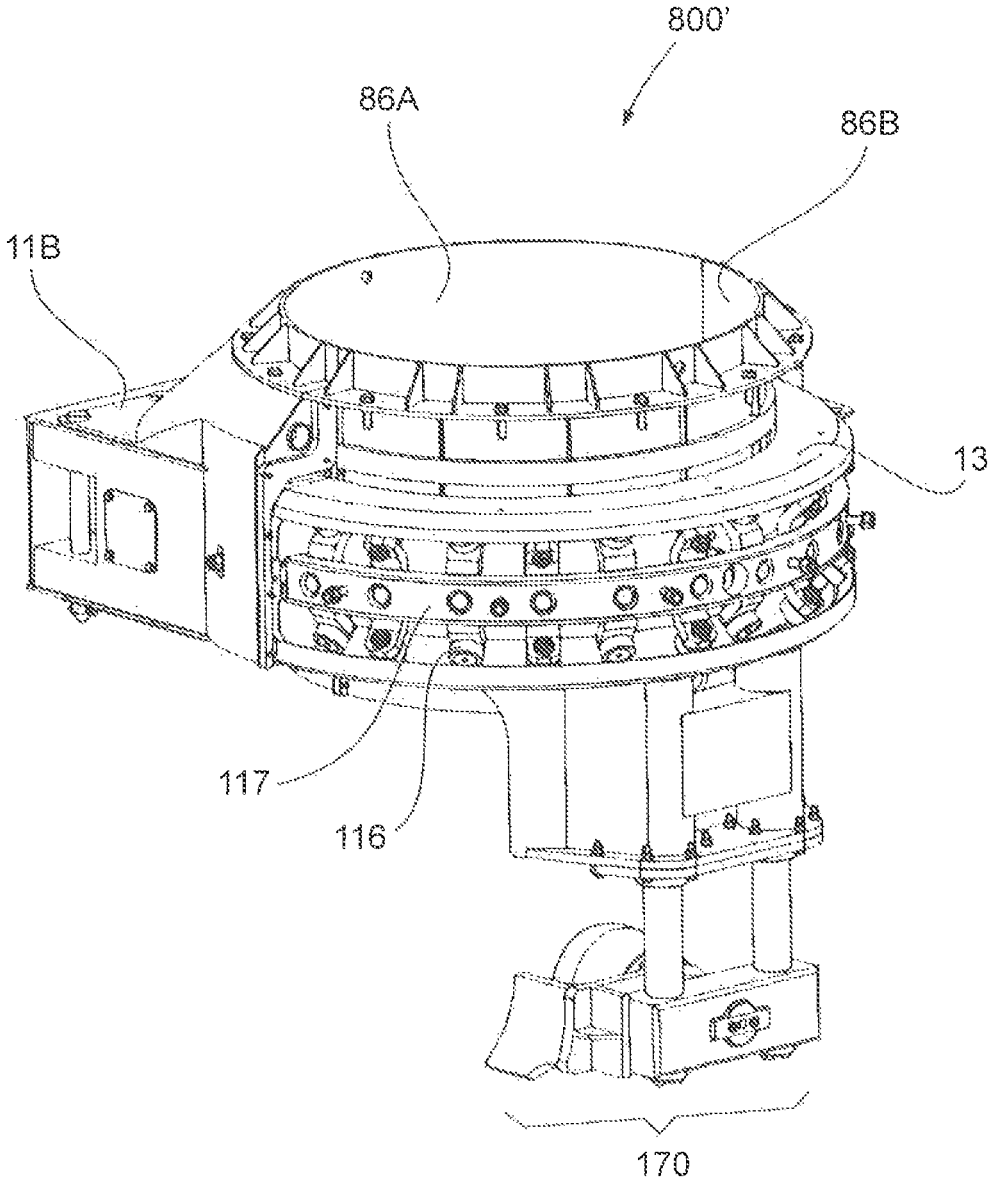
Figure 15:
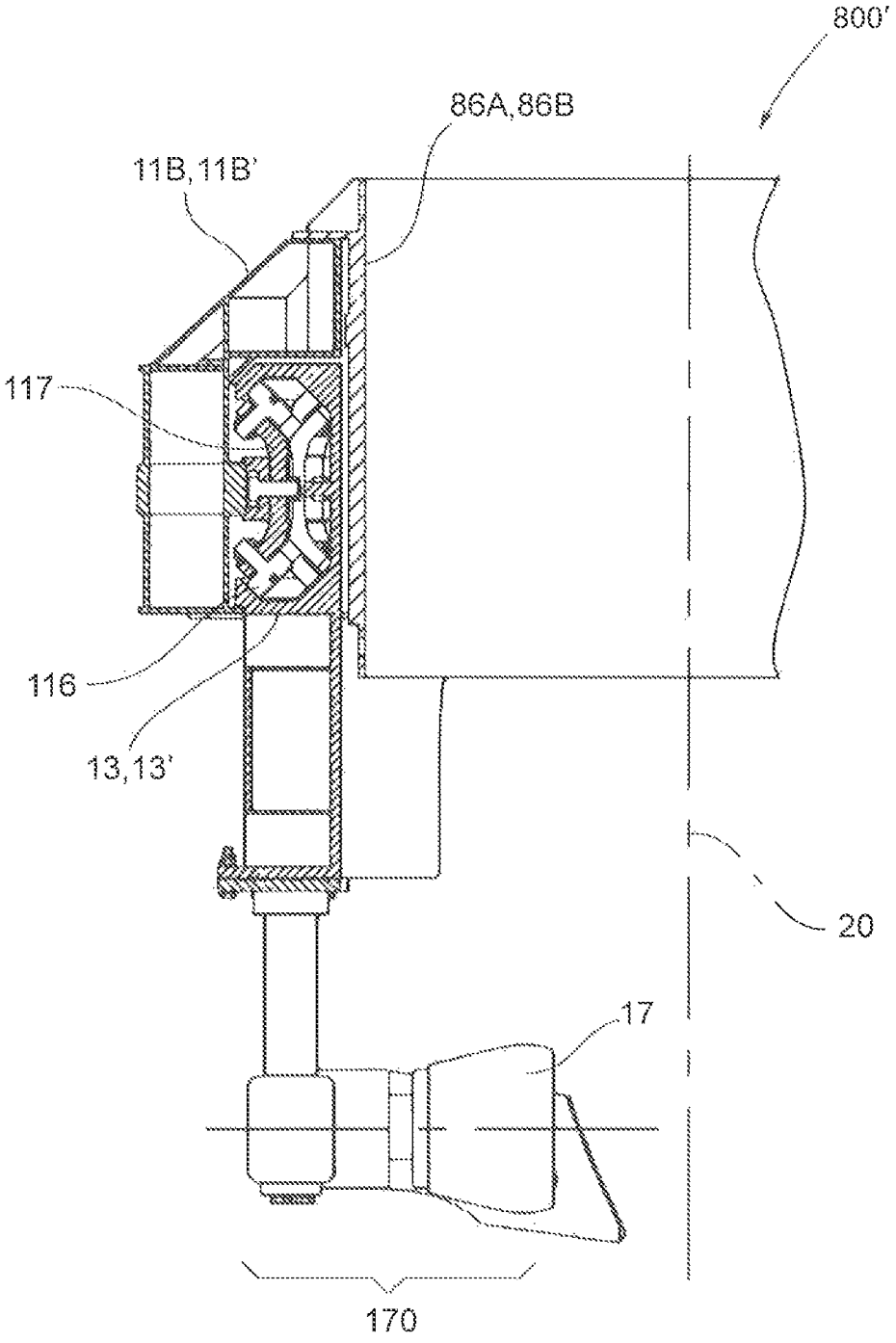

FIG. 14 shows a perspective view of the cleaning device of FIG. 12 in which one of the static parts of the tool-holder support is hidden;

FIG. 15 shows a section view of a detail of the jaw of FIG. 12, according to a normal observation direction at the rotation axis of the drilling screw.

DETAILED DESCRIPTION

Figure 1:
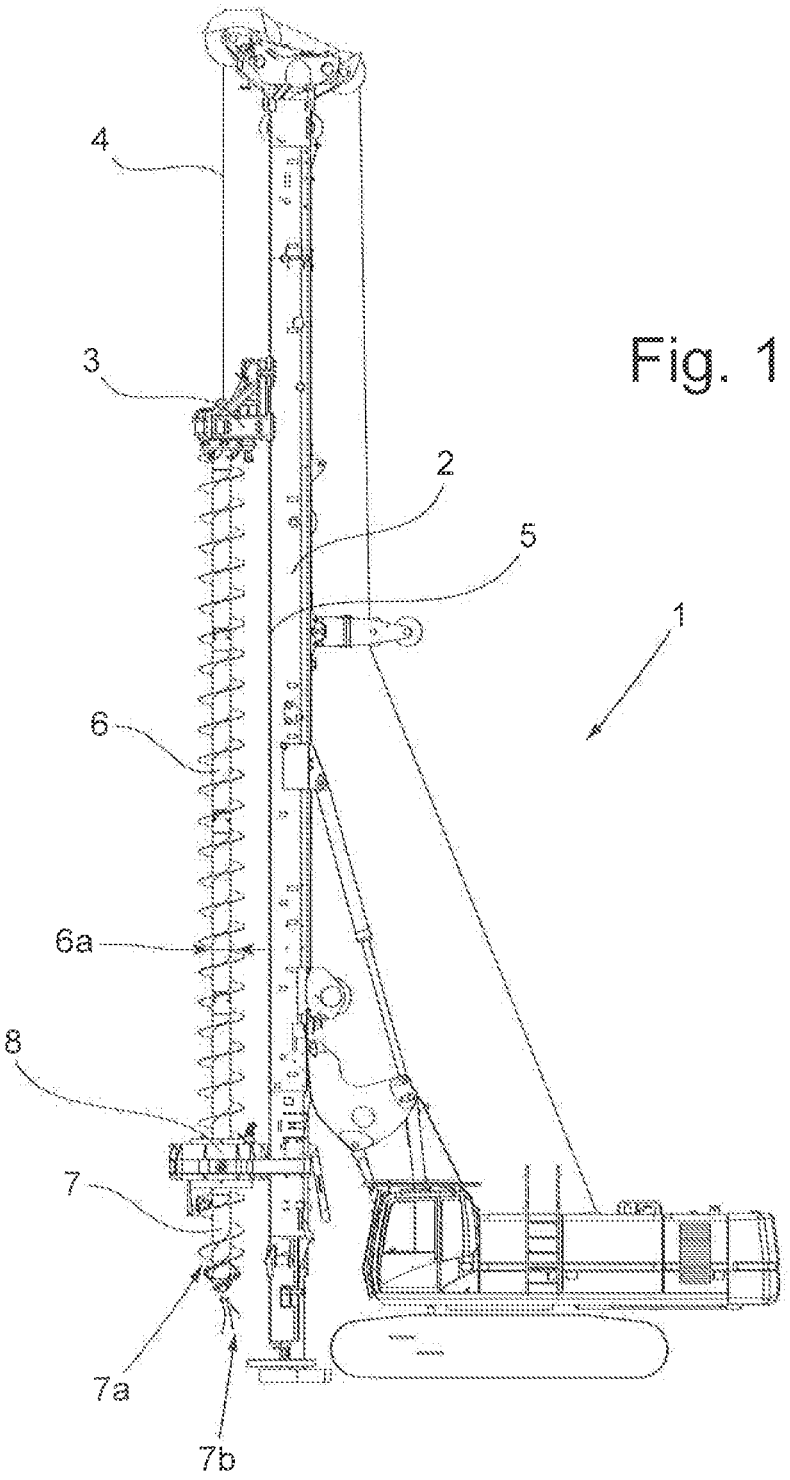
FIG. 1 shows a side view of a drilling machine according to a first embodiment of the invention.

FIG. 1 shows an example of a drilling machine, wholly indicated with reference numeral 1, on which an auger cleaner according to the invention can be used. La drilling machine 1 can be tracked and provided with a guiding tower 2 that is fixed through a lifting linkage to a rotary tower on the tracked vehicle. Said guiding tower 2 can mount, on its front part, a rotary table 3—also called rotary 3—that is arranged for transmitting the torque necessary for the drilling and is provided for example with pulling means 4 and optionally thrusting means—typically a winch cable or with other similar mechanical means, like for example cylinders, racks and pinions—that are suitable for making said rotary table 3 to slide along the guides 5 with which the tower 2 is preferably equipped, for example for its entire length.

A helical drilling tool or auger 6, conventionally called "continuous auger", is fixed to the rotary table 3 and receives from it the rotation movement through which, when fitted in the ground, it obtains a hole with a diameter that is substantially equal to that of the its turns and with a depth that is comparable so its length by means of drilling teeth 7*a* that are fixed in the turns of the bit of the auger 7. The core of the auger 6*a* is preferably hollow—and it is therefore sometimes also called "tube"—and can end in the lower part with a door 7*b* that is kept closed in the drilling step and can be opened with the pressure of the filling fluid that is pumped through the core 6*a* when, once the drilling step has finished, the auger is brought back towards the surface. An auger cleaning device 8, 8', 800, 800' according to the present invention can be for example mounted along the guiding tower 2, and in particular for example at or close to its lower portion.

FIGS. 2A, 2B 3-7, 10, 10A are relative to an auger cleaning device according to a first embodiment of the invention, wholly indicated with reference numeral 8.

Figure 2B:
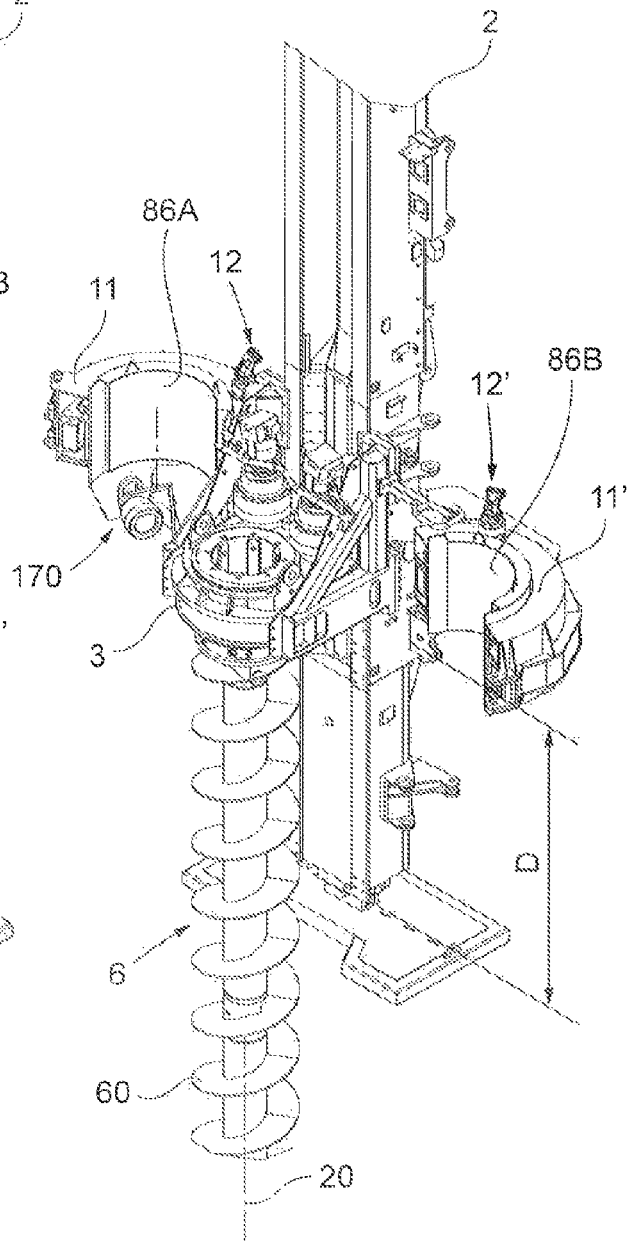

The drilling tool 6 shown in FIGS. 2A, 2B comprises an auger with a single thread or single-start 60 but, in embodiments that are not shown, it can comprise screws with many threads, i.e. with multi-starts.

According to one aspect of the invention, the auger cleaning device 8, 8', 800, 800' in brief in the present description also indicated as cleaner 8,8',800,800'" or "auger cleaner 8,8',800,800'", comprises:

- a tool-holder support;
- at least one cleaning tool 170 constrained to the tool-holder support.

The cleaning tool (170) is arranged for being actuated by an actuation system (12,12',4).

The tool-holder support is arranged for reversibly passing from an open configuration to a closed configuration so that:

- in the closed configuration the tool-holder support forms a pass-through opening 82 that is arranged for allowing the passage of a helical drilling tool 6, the cleaning tool 170 engaging with the screw of the drilling tool 6—for example engaging with at least the upper surface of the auger on which the tool 170 abuts and for example extending inside the pass-through opening 82 or rather inside the projection of such an opening in the direction of the drilling axis—and, actuated by the actuation system 12, 12',12" 4, it is arranged for rotating around the drilling tool 6 following at least one of its threads 60 so as to remove the debris lying on the drilling tool 6 (FIGS. 2A, 2B, 5A, 5B, 6A, 6B), for example making them fall;
- in the open configuration the cleaning tool 170 is disengaged from the drilling tool 6 and is preferably farther from it, with respect to how far it is in the closed configuration.

The cleaning tool 170 can extend for example in a direction that is substantially radial with respect to the drilling tool 6 when the tool-holder support is in the closed configuration.

Advantageously, the cleaning device 8 is arranged for making the cleaning tool 170 and the possible perimetral walls 86A, 86B described later on, carry out rotations equal to or greater than a complete turn around the screw of the drilling tool 6.

Said cleaning tool 170 is constrained to the tool-holder, for example it is fixed to the mobile part of the tool-holder support. This mobile part is guided with respect to at least one of the fixed parts which the tool-holder support is made of and being able to move, when actuated by the actuator 12, with respect to it. Preferably said movement is a rotation.

As shown in FIGS. 2A, 4A, 6A, 9 the pass-through opening 82 can have the form of a cylindrical through hole, advantageously having circular sections.

As shown in FIG. 6A, the tool actuation system can for example comprise two actuators 12, 12' (but there could also be only one) which are preferably two rotary hydraulic motors which can optionally also include a reducer group. In other embodiments that are not shown however, such actuators can also be motors of other types, for example electric, pneumatic, linear motors in general. The actuators 12, 12' can be mounted on a same tool-holder support, for example on the jaws 11, 11' and/or on the rotor 13, 13' described in the rest of the description. As shown in FIGS. 2A, 2B, 3, 12, the tool-holder support can be for example integrally fixed to the guiding tower 2 in a fixed position with respect to it, but like for example in the embodiments of FIGS. 9, 9A, 11 it can also be axially released on the tower 2. In the embodiment of FIGS. 9 and 9A the tool-holder support is connected to the tower 2 for example through a suitable trolley or shoe 90, so as to be able to slide along it and along the axis 20 of the helical drilling tool 6, and be able to lifted and lowered.

In order to be able to reversibly open and close, the tool-holder support can comprise two jaws 11, 11' that can be reversibly opened. Said jaws 11, 11' can be monolithic and in such a case they preferably have a first section in the form of a beam or arm, which is connected to the tower 2, and a second section in the shape of a semicircular shell. In an alternative embodiment of the jaws, the beam section and the semicircular shell section can make up the two distinct bodies that can be separated from one another.

Preferably the pass-through opening 82 is bounded by one or more perimetral walls 86A, 86B each of which faces the inside of the pass-through opening itself and, in the open configuration, the one or more perimetral walls are further away from the helical drilling tool 6 (FIG. 2B), with respect to when they are in the closed configuration (FIG. 2A).

Figure 3:
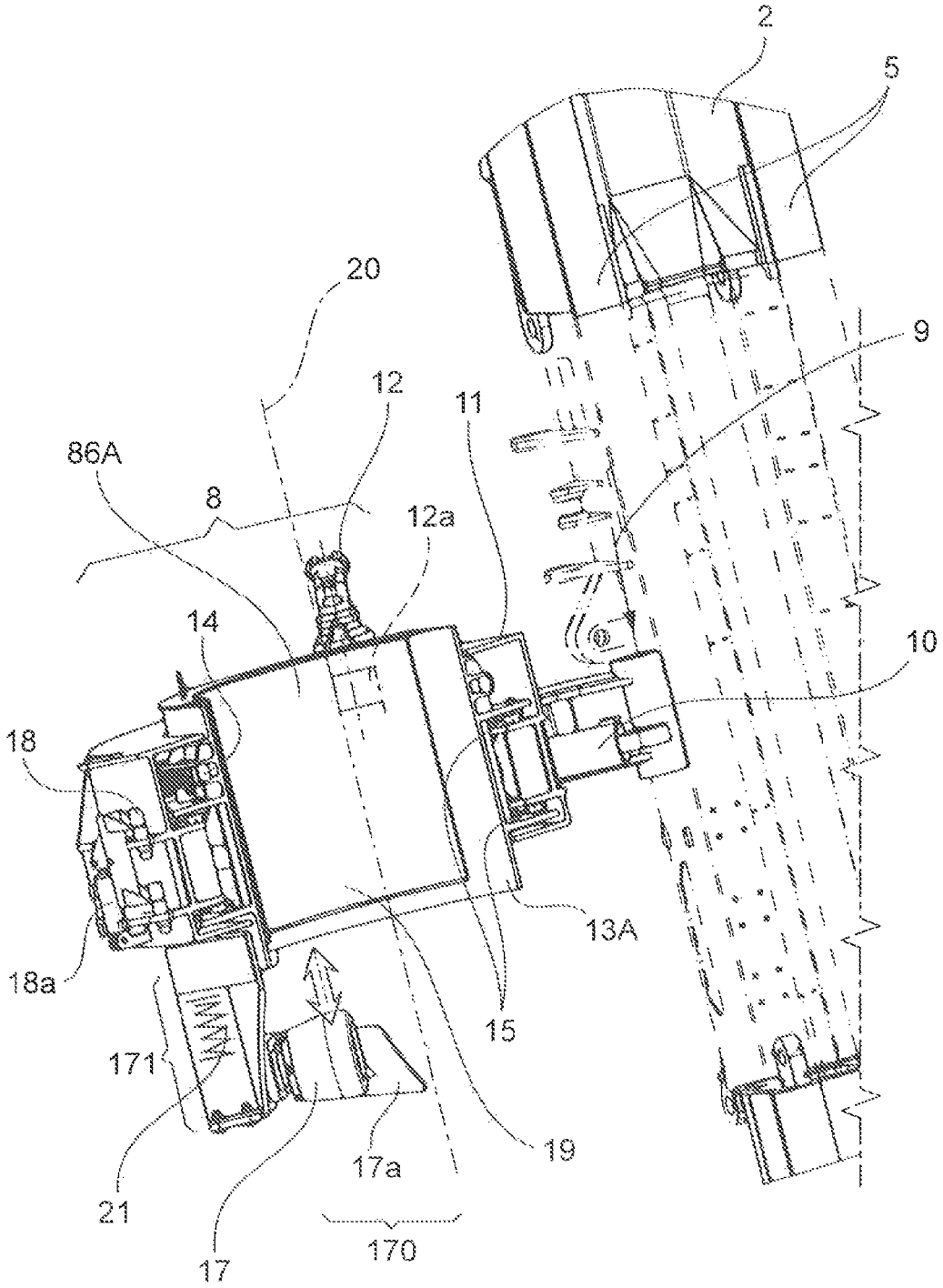
FIG. 3 shows a perspective view of a jaw of the cleaning device of FIGS. 2A, 2B.

Preferably there are at least two perimetral walls 86A, 86B and they each form a concave seat which, as shown in FIGS. 2B, 3, preferably has the shape of a semicylinder that is cut longitudinally, or in any case of a cylindrical sector.

Preferably each of such concave seats is arranged for:

housing a part of the sides of the screw of the drilling tool 6 extending around a part of the perimeter of the cross sections of the screw;

reversibly opening and closing making the tool-holder support 8 pass from the closed configuration to the open configuration.

Preferably the helical drilling tool 6 is fixed to a rotary table 3 that is arranged for rotating the drilling tool around its own longitudinal axis 20; generally the rotary table has an encumbrance such as to not be able to pass through the pass-through opening 82 of the tool-holder support in the closed configuration.

Advantageously in the open configuration the tool-holder support is arranged for allowing at least one part of the rotary table 3, and more preferably the entire rotary table, to pass through the tool-holder support, for example by opening the jaws 11, 11' and/or the perimetral walls 86A, 86B (FIG. 2B). The first perimetral wall 86A is constrained to the first jaw 11 and the second perimetral wall 86B is constrained to the second jaw 11'. The perimetral walls 86A, 86B can be fixed rigidly respectively to the jaws 11, 11' or they can be released in rotation.

In the closed configuration the cleaning device 8 is preferably arranged, through the one or more actuators 12, 12', for not only making the cleaning tool 170 rotate, but also the first 86A and the second perimetral wall 86B, preferably integrally with respect to one another, around the axis 20 of the helical drilling tool 6 (FIGS. 6A, 6B).

Figure 4:
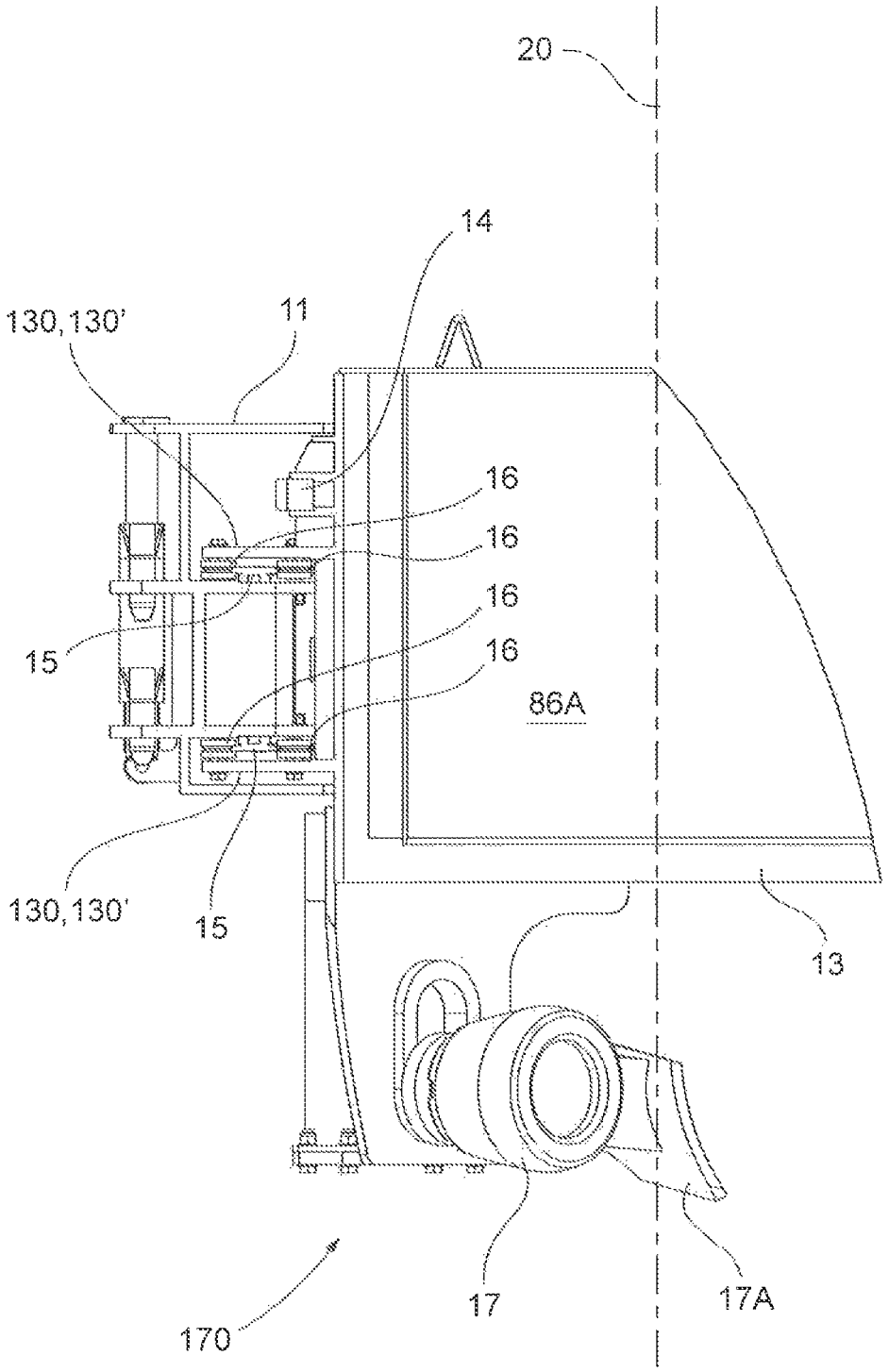
FIGS. 4 and 4B show a first and a second side view of a detail of the jaw of FIG. 3, according to a normal observation direction at the rotation axis of the drilling screw.
Figure 4A:
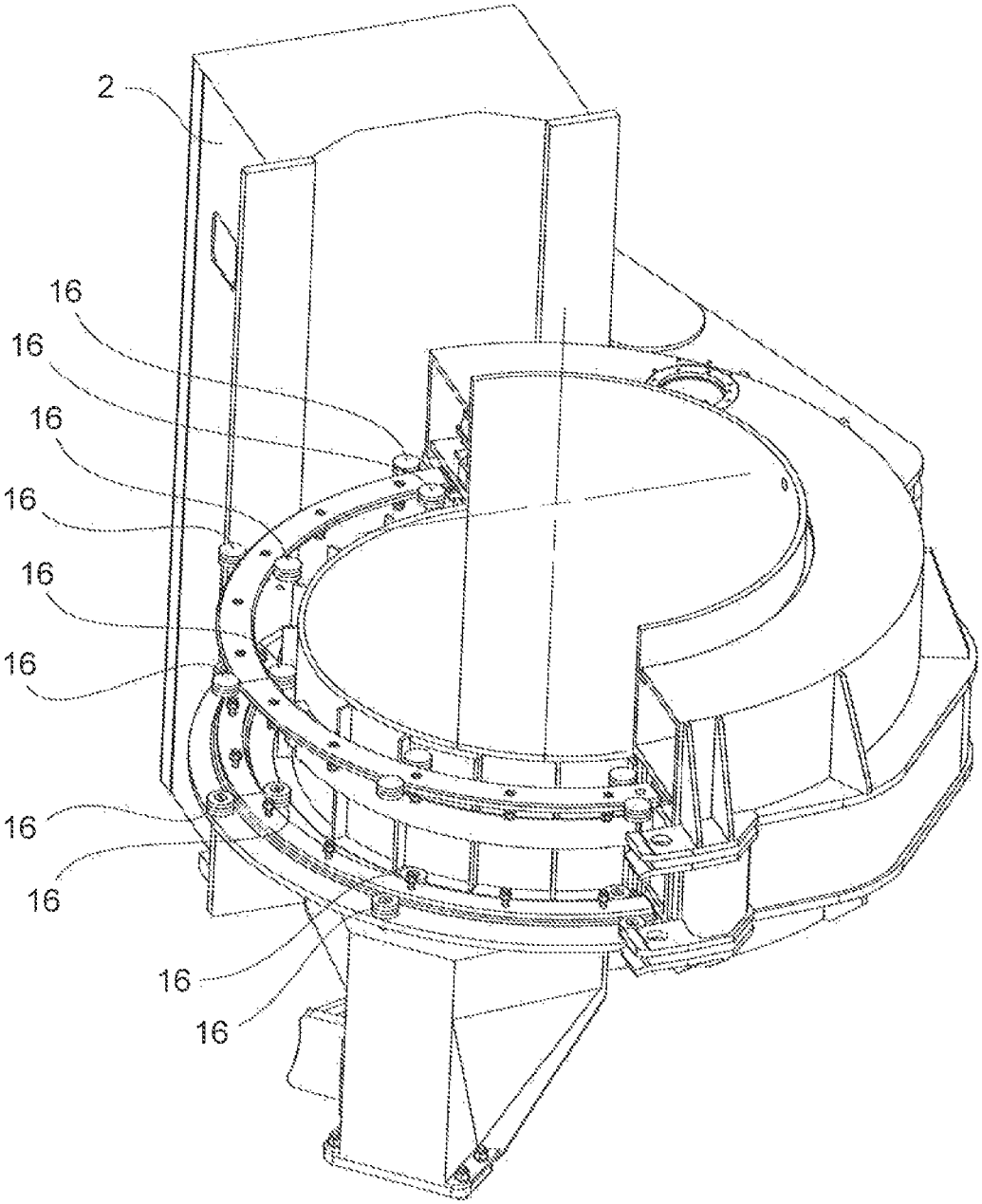
FIG. 4A shows a second perspective view of the cleaner of FIG. 2A, closed.
Figure 4B:
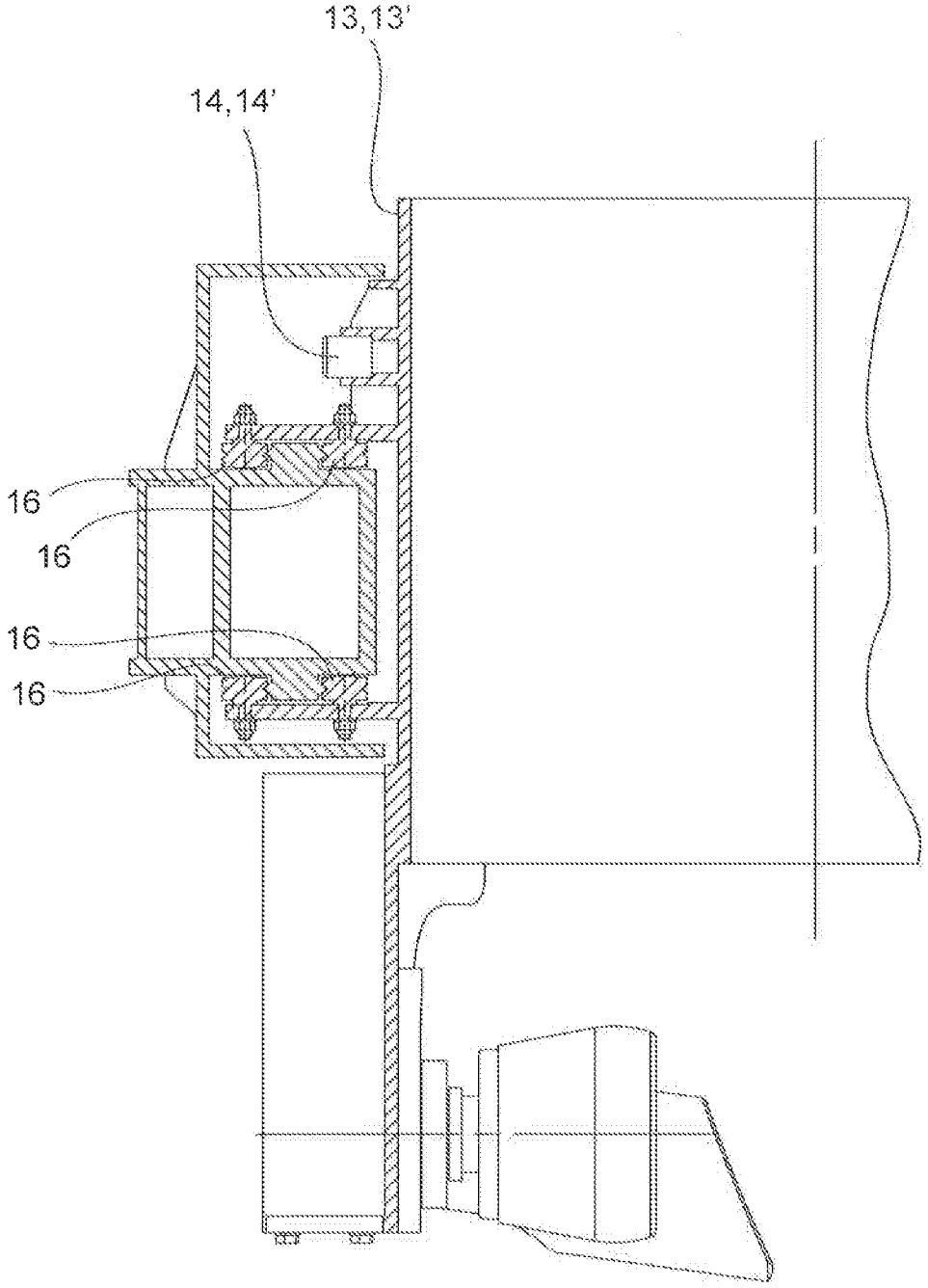

The perimetral walls 86A, 86B can be integral with and be part of a relative rotor 13, 13', i.e. of a more complex body that is arranged for rotating around the screw of the drilling tool 6 when the cleaner 8 is in the closed configuration (FIGS. 3, 4, 4B). The rotor (13 or 13') can comprise at least one among the following elements: a cleaning tool 170, an arc of rack (14 or 14'), a diametrical wall (86A or 86B), a sliding guide, a track and a shoe, a trolley or another type of slider.

FIG. 2A illustrates the cleaner 8 in its operative condition, while it embraces and guides with its structure the continuous auger 6. This first embodiment of the cleaner 8 is thus a sleeve that wraps around the auger 6 along the entire perimetrical path. In this closed condition its shape does not allow the cleaner 8 to be passed through by the rotary table 3 which, with a cleaner of the known type, should stop near to its upper part, neutralising every other further downward stroke which in any case would be available.

FIG. 2B illustrates the same cleaner 8 in a non operative condition, which is open in at least two sectors or jaws 11, 11', so as to allow the rotary table 3 to transit through said open jaws 11 and 11', in an at least partial manner i.e. such as to allow it to pass without obstacles for its entire axial extension or even only for a part thereof, thus being able to exploit the entire stroke available. Passing through the cleaner 8, for the depth of the excavation, the distance D which separates the upper portion of the cleaner 8 from the lower part of the tower 2 is made available. The cleaner 8 is represented as a non limiting example, without vertical sliding with respect to the tower 2 fixed to it through removable fixing systems, e.g. pins 9 and is hydraulically opened/closed for example by means of hydraulic cylinders 10, 10' (FIGS. 6A, 7).

FIG. 3 represents some components of the cleaner 8. The cleaner 8 comprises two halves 11, 11' that are approximately but not necessarily the same. For the sake of simplicity of representation only one has been shown. FIG. 3 is not a section but it represents elements in sight. A structure that is for example overall semicircular 11, 11', from here on referred to as "static part" or bracket-jaw 11, 11' is constrained to the tower 2 for example through hinges with a vertical axis and fixed with pins 9 and capable, preferably by means of an actuator, e.g. a cylinder 10, 10', of carrying out a rotation on the horizontal plane. This rotation advantageously has a width such as to place the structure of the cleaner outside the encumbrance of the rotary table 3 that transits along the guides 5 of the tower 2. Therefore preferably, in order to reduce the extension of the opening arc and for making the passage more effective, the hinge of the pin 9 is located in the rear area of the tower 2, on the opposite side with respect to the part facing the excavation (better visible in FIG. 6A). A motorised rotary means, e.g. a geared motor 12 including a pinion 12*a* is bolted on the semicircular structure 11. Another overall semicircular structure 13, 13' from now on called "rotating part" or "first rotor 13" and "second rotor 13'" with a smaller diameter with respect to the bracket-jaw 11, 11' is mounted inside the latter. On the external part of each structure 13, 13' a preferably semicircular rack 14 is fixed the teeth of which are engaged on the means that give the rotation torque, in particular on the at least one pinion 12*a* that is guided on the static part 11. Shaped semicircular guiding tracks 15 that are bolted on two horizontal planes obtained in the static part 11 ensure the correct sliding of the rotating part 13, 13' which, moved by the pinion 12*a* that turns on the outer part of the semicircular rack 14 allows the rotating part 13, 13' to carry out revolutions around the axis 20 of the auger 6. Shaped rollers 16, preferably with dove-tail sections, and bolted on each rotating part 13, 13' are arranged for sliding with minimum clearance at the edges of the shaped tracks 15 and ensure the guidability of the rotating part inside the static one as well as the reduction of friction between the two parts. Basically, they act as bearing elements for reducing the friction between the two parts ensuring a circumferential trajectory to the rotating part. The embodiment of FIG. 4B, should not be taken for limiting purposes, in such an embodiment the shaped rollers 16 have a vertical axis, they could have an inclined or also horizontal axis and if there are enough of them and if they are in the right arrangement (roller runs on the guide 15 on the side of the guide thickness), they may not be shaped. In an alternative solution, the rollers 16 could also be replaced by guiding and sliding elements that do not rotate, like for example shoes, which are made from a material having low friction—like for example ertalon, nylatron, another plastic material or bronze or brass—but in this case the friction coefficient would be greater and the torque required for the rotation of the cleaning tool would be higher. In this solution the rotating parts 13, 13', and in particular their radial projections 130, 130' thus slide like shoes along the tracks 15.

The cleaning tool 170 can comprise at least one roller with a substantially horizontal axis 17 that is mounted on bearings and is fixed—or in any case integral—preferably in the lower part of the rotating part 13 or 13'. Therefore even if the rotating part were mounted externally with respect to the fixed one (FIGS. 8, 8A,14,15), only protruding on the lower part, it could in any case be possible to be mounted also in this variant. In this case the concave seats 86A and 86B would not rotate integral with the cleaning tool 170 and with the rotating parts 13 and 13', but they would be fixed and integral to the bracket-jaw 11, 11'. Said roller 17, set in rotation around the axis of the auger 20 by the geared motor 12 is inserted inside the turns of the auger 6 through the actuation of the cylinder 10. Its descent along the slope of the auger and its shape ensure the removal of the ground deposited there. When the roller does not have transversal dimensions such as to occupy great part of the space between the turns, a blade or plough 17*a* preferably mounted in front of the roller is inserted, acting as a "scraper" and it facilitates the manoeuvre in the case of cohesive ground. More in general the cleaning element 170 which mechanically achieves the cleaning of the auger, can consist of at least one or more of a combination of the following elements: roller 17, plough 17*a*, brushes, cables, . . . . Roller and plough represented in FIG. 3 are mounted on the support arm 171 in a fixed manner or in a floating manner, for example damped. In the second case, an elastic contrasting element, for example a spring 21 ensures the compression of the roller against the turn of the auger but it "yields" if the pressure on the roller 17 exceeds a certain threshold, this device is very useful in the case in which the cleaner 8 is fixed axially to the tower 2. A manual or automatic locking system 18, preferably with a mechanical counteraction, ensures the reciprocal closure between the two halves of the cleaner and their locking in the operative position. Such a locking may not be necessary if the opening arms of the cleaner 8 rotating on the hinge 9 could be firmly locked, therefore in the case in which the opening is motorised by cylinders 10, in which they are equipped with locking valve means that constrain the parts of the cleaner that can be opened to be constantly brought together or pressed against one another. Possibly, an accumulator could ensure that the pressure on the cylinder 10 is kept also in the case in which there are losses or faults in the system. An activation signal exerted for example by a manual command or managed automatically by a control unit, actuates the rotation power group, which in the case represented in FIG. 3 comprises a geared motor 12, only after the closure of the hydraulic cylinder 18*a* or together with the movement towards one another of the two openable parts 11 and 11' of the cleaner. The rotating part 13, being preferably the inner element, acts also as a guide that is radial to the auger 6, to ensure the verticality of the excavation in the first meters. In such a way it is no longer necessary to insert additional openable guides, as was necessary in the state of the art, below the cleaner on the tower 2. As a function of the diameter of the augers used, reductions 19 can be fixed inside the rotating part 13. In the case in which the rotating part 13 is external, then the guiding function will be carried out by the fixed part 11 which is also equipped with a semi cylinder with a diameter that is compatible with the auger with maximum diameter and the reductions 19 are inserted on said semicylindrical part. The axial extension of said semicylindrical section, in both cases is preferably greater than the pitch of the auger. When the two jaws 11, 11' of the cleaner 8 are brought to one another, as indicated in FIGS. 10 and 10A, so as to be brought into the operative position, there is advantageously an axial reference 172A and 172B between the two parts—like for example a male-female coupling, a pin, an indentation or a reference tooth—so as to ensure that the reciprocal position is correct also in this direction. Preferably, such an axial reference is positioned opposite with respect to the tower 2, near to where the lock bolts 18 are represented.

FIG. 4 shows a detail of the members for sliding between the fixed part 11 and the rotating part 13. The semicircular rack 14—that could be made up of a group of arch-shaped elements fixed in a removable manner to the rotary drum or welded to it—fixed on the rotating part 13 receives the movement from the pinion 12*a* guided by the static part 11. The contact with low friction between the two parts is advantageously promoted by the rollers with a dove-tailed throat 16 that are fixed on the rotating part 13 that slide at the sides of the calibrated guides 15 with a cusp section, bolted on the static part. It is possible, if considered more advantageous, to fix the rollers 16 on the static part 11 and the calibrated guides 15 to the rotating part 13.

As an alternative to the roller 17 or to the assembly comprising the roller 17 and the plough 17*a* in the case in which for example the cleaner 8 is fixed on the tower 2 in a predetermined area, brushes, which are not shown, can be used obtained by using stranded metal cable portions. In this case the brushes could be arranged in the axial direction, such as to completely cover the space between the two turns. Again it is possible for there to be a combination of roller 17+brushes so as to allow the application in the case in which the cleaner 8 is axially mobile with respect to the tower 2.

FIGS. 5A, 5B show an optional locking and safety hydraulic system that stops the semicircular rack 14 and the rotating parts 13, 13' in a precise, safe and certain position with respect to the static portion 11. In FIG. 5A, a hydraulic cylinder 22 ordinarily retracted when the semicircular racks are moving, is pushed radially towards the convex surface of the rotating part 13, when it is desired to stop the movement of the latter in a precise and predetermined position. At the pin 22*a* pushed in a direction of the axis of the auger 20 by the cylinder 22, the rotating part 13 has a sliding "track" 13*e* that is perfectly smooth and cylindrical, except for in a point 13*f* where a recess is arranged that houses the conical tip of the pin 22*a*. An automatic sequence can switch the normal movement to a slow movement, when it is desired to stop the system. The switching triggers the opening of the cylinder 22 that pushes the pin 22*a* against the track 13*e* until it encounters, only once in its revolution, the recess 13*f* in a precise and predetermined place, as illustrated in FIG. 5B. A hydraulic command sequence stops the movement of the reduction units 12 and locks the pinion 12*a* in this last predetermined position.

A further embodiment as an alternative to the previous one comprises the combination of encoder or proximity sensor for determining the correct angular position of the rotating part 13,13' that must face the correspond line static part 11, 11' and possibly blocked with respect to one another with a stop device or an abutment. In this condition, each of the rotating parts 13, 13' is completely contained in the respective static part 11, 11'. Indeed, during the opening or the closing of the tool-holder support, said parts—mobile and static parts—must not interfere with one another preventing the movement of the support itself. The same movement group 12, could be locked in rotation with valve means or with mechanical abutment means that can be actuated manually or automatically. Once a configuration has been reached in which the rotating part 13 is for example entirely contained in the static portion 11 and only in that portion, then the encoder or proximity sensor will send the confirmation signal that will enable the two parts to be locked to on another.

FIGS. 6A, 6B show the operation of the rotation system of the rotating part, obtained through the transit of the two semicircular racks 14, 14' in front of pinions 12*a*, 12*a*'. Previously the two parts that make up the assembly of the system 11, 11' have been placed in mutual contact with one another through the cylinders 10-10' and possibly integrally fixed to one another by the system of lock bolts 18-18*a* (FIG. 6A). In this configuration there are two rotation groups and the two pinions 12*a*-12*a*' each engaging its own semicircular rack 14-14' are unblocked and start giving a rotary movement to the respective racks. When they are not unblocked, they keep blocked the rotating part they are in charge of, with respect to the static part 11 avoiding possible rotations also when the cleaner 8 is not in the operative position, i.e. when it is disengaged from the auger 6. The racks "follow" one another around the axis of the auger (20) and each one is taken on, first by one pinion and then by the other. In the moment in which, both the pinions engage a single semicircular rack, the second one is pushed on by the movement of the first one, (FIG. 6B) because the two parts of rack are always in contact with one another so as to correctly reset the geometry of the toothed profile also near to the division between the at least two elements. At least one of the two racks 14-14' carries the cleaner element 170, comprising for example a roller 17 having a radial axis described in FIG. 3, which provides for supporting the weight of the cleaner 8 in the case in which it is not constrained to a fixed point of the tower 2 and for cleaning the ground deposited between the turns of the auger. When it is desired to interrupt the movement, the procedure like in FIG. 5 is triggered and the system returns to being like in FIG. 6A. The preferred embodiment is that in which there are two opposite rollers 17 for contrasting and balancing the excavation thrusts.

FIG. 7 shows the cleaner 8, in a section like in FIG. 6B, in the moment in which the two parts of the system are open, in a non operative position, remote with respect to the disc of the auger, and allow the at least partial transit of the rotary table 3 digging towards the lower part of the tower 2 for completing the drilling step. The racks 14-14' are kept locked in rotation by the respective pinions 12*a*-12*a*' that are held blocked by the actuation system 12-12' not unblocked or locked by suitable valve means. This does not preclude the presence of additional locking safety systems, which are automatically activated, or caused by the opening of the two parts of the cleaner 8 or activated manually. In one variant each of the mobile parts could be hooked with the service cable, which when pulled, could exert an opening and closing force. In particular by combining a return pulley with horizontal axis (not shown) to the cable and fixed on the tower 2.

In the open configuration of the tool-holder support, shown in FIG. 7, the shaped guiding tracks 15, the rack sections 14 or other sliding elements are separated in at lease two sections having an overall shape that is substantially an arc of a circle, and possibly semicircular. When the tool-holder support returns into the closed configuration, the shaped guiding tracks 15, the rack sections 14 or others substantially form a ring allowing the cleaning tool (170) to rotate around the helical drilling tool (6), sliding with respect to the track and describing at least one complete rotation around the helical drilling tool (6);

FIG. 9 shows a view from above of the cleaner 8 in the two operative configurations in which a frame is highlighted in a broken line that is a trolley 90 that embraces the rear part of the tower 2, on which it is guided in a sliding manner for axial displacements. The trolley is behind the antenna so as to allow the passage of the rotary 3.

FIG. 10 shows a perspective view of a detail of the axial reference 172A-172B that is positioned near to the lock bolts 18 for constraining the two parts that can be opened, when they are closed in the operative cleaning condition.

FIGS. 8, 8A are relative to a cleaner 8' according to a second embodiment of the invention, in which the movement of the cleaning roller is given to at least one actuator (12") of the magnetic movement type to manage, preferably comprising a stator 35, 35' and at least one magnet 34 that form one or more torque motors with a system of the "direct drive" type. A static part 80'A, which is hinged to the tower 2 through pins 9 and preferably driven to be opened/closed by cylinders or actuators 10—pins and actuators not shown, but for example identical to the previous ones—is located, in its operative condition, around the axis 20 of a hypothetical auger 6, in a form in which it is wound around the sleeve, identifying a pass-through opening 82. Like in the previous figures, the cleaner 8' can comprise at least two parts, in the simplified non limiting representation exactly two, of which for the sake of simplicity of representation, only one is represented. One rotating part 31, also indicated as a rotor 31, for certain aspects similar to the previous one 13 and represented out from its sliding seat, carries the cleaner element 170 comprising for example the roller cleaner 17 and/or the plough 17*a* and if present also the spring 21. A calendered "track" with its ends for example in a dove tail 32 is fixed to the outside of a drum, in the lower part of the static part 80'A.

Rollers 33 that are mounted on bearings, and which are vertically fixed in the rotating part 31 slide on the aforementioned dove-tail 32. The rollers are represented in a non limiting manner in a number of four, and embrace in a precise manner the cusps of the calendered track 32. The throats of the rollers, that are associated with the cusps of the track, ensure the effective guiding and the sliding with low friction of the rotating part 31 for the entire semi circumference represented by the track 32 and also in the corresponding semicircumference 32' of the track present in the static part 80'B corresponding to the 80'A and fixed to this in a safe and integral manner by means of lock bolts that are similar to the lock bolts 18-18*a* that are illustrated for example in FIG. 3. As previously mentioned in the description of the cleaner 8, it is possible to vary the arrangement and number of the rollers leaving however the functionalities described here unaltered. The electric "direct drive" motor, comprises a magnet 34 which is mounted for example in the convex part of the rotating part 31 and a stator preferably made up of at least two sections or sectors 35, 35' each of which is supplied electrically, with a semicircular shape and with a width such as to cover the entire arc of competence of the sector, for example in this case 180° is mounted for example respectively in the static part 11, 11'.

The rotating part 31 is guided with the rollers 33 on the track 32 of the static part 11. The magnet 34 preferably faces the stator 35 or 35' at a radial distance that is well calibrated so as to allow it to operate correctly. By actuating the various elements of the stator in sequence, a tangential movement of the magnet is induced consequently covering the entire circumference. Substantially, in the embodiment of FIGS. 8, 8A the cleaning tool 170 is fixed on a rotating part 31 which is a trolley that can possibly form the single rotor of the cleaning device 8'. When the tool-holder support is closed, for example because the two jaws 80'A, 80'B are closed, the rotating part 31 or trolley is arranged for sliding along the ring-shaped guide formed by the tracks 32 and 32' so as to achieve many complete turns around the axis of the auger 20. In one variant already indicated also for the previous solution, there can be two rotating parts 31 (31A, 31B) mounted opposite one another so as to balance the cleaning forces. In particular the two rotating parts could be guided by the same track 32, 32' or by two separate tracks and said parts can be kept at the correct distance with mechanical separator means or through an electric control.

FIG. 8A shows a view of the solution with motors with permanent magnets of FIG. 8, highlighting with thicker lines the rotating part (roller with scraping blade, roller supporting element, and bearing rollers, in this case mounted with a horizontal axis that roll on the circular prism-shaped guide which is integral with the stationary part).

The rotating part 31 is in this case represented with a reduced angular bulk and therefore it is easy to identify how much it is completely contained in the fixed part 80'A so as to allow the opening of the jaw. Said rotating part 31 can be locked in a predetermined angular position, in which it completely faces either the fixed part 80'A or 80'B and, once this predetermined configuration has been reached, the opening of the cleaner is enabled and the rotating part is temporarily locked on the fixed one. In a further variant embodiment, the calendered track or other sliding guide 32 could be made on the part 80A or fixed to it, for example making a cusp above and one below the stator 35. The rollers 33 can be in this case fixed onto the opposite face of the rotor 31 so as to be coupled with the guides 32. In this constructive variant it could be possible to constrain one of the perimetral walls 86A, 86B to the rotating part 31. The perimetral walls would be in this case released in rotation with respect to the static parts 80'A, 80'B and would be driven in rotation by the rotor 31.

FIG. 11 illustrates a cleaning device 800 according to a fourth embodiment of the invention. In this embodiment, there are all the constructive elements that have already been described in the first embodiment and in FIGS. 2A, 2B, that for coherence are indicated with the same numbers but are different for two additional characteristics. The first characteristic is that the jaws 11,11' of the tool-holder support each comprise a distinct first part 11A,11A' and a distinct second part 11B,11B' that can be reversibly engaged or disengaged from one another. When said parts are engaged with one another they behave like two integral bodies and the tool-holder support can reversibly pass from a closed configuration to an open configuration like in the embodiments previously described. The second characteristic is that when the static parts 11B,11B' of the tool-holder support are in the closed configuration, they can be guided on the front guides of the tower, preferably the same on which the rotary 3 translates, and slide on them disengaging from the parts 11A,11A' reaching the condition shown in FIG. 11. The parts 11A and 11A' can have the shape of a beam, they can be constrained to the tower, possibly through a support frame, and they can keep a fixed position in the axial direction with respect to the tower. They can be hinged to the tower for example through pins 9 and they can open or close by rotating on a horizontal plane by means of actuators 10,10' like for example hydraulic cylinders. When the parts 11B, 11B' are engaged on the parts 11A,11A', they rest on the parts 11A,11A' and are locked in an axial downward direction through a mechanical abutment. The axial upward sliding is not prevented. The movements of the parts 11B, 11B' on the horizontal plane are prevented by two couplings of the pin-cavity type. As visible in FIG. 11, on the lower faces of the parts 11B,11B' there can be pins 111,111' that protrude downwards and that can be inserted in special cavities 112,112', present on the parts 11A,11A', when the parts 11B,11B' are in a position engaged on the parts 11A,11A'. Of course it is possible to reverse the arrangement of the pins and of the cavities, obtaining pins that protrude from the upper faces of the elements 11A,11A' and making cavities on the parts 11B,11B'. The static parts 11B,11B' of the tool-holder support can be equipped in their rear part with trolleys 110 that are integral with said static parts and are provided with sliding shoes. The trolleys 110 can be coupled with the front guides of the tower 2, when the tool-holder support is in the closed configuration and can be disengaged by abandoning such guides when the tool-holder support passes to the open configuration.

FIG. 12 illustrates a cleaning device 800' according to a fifth embodiment of the invention. Said solution is different from the first embodiment of FIGS. 2A,2B mainly due to the fact that the rotating part 13 that holds the cleaning tool does not comprise an arc of rack 14, it is not coupled to geared motor pinions 12,12' and is mounted on the static part 11 so as to be able to be always free to rotate during all the operative steps of the cleaner. For such a reason this solution is also called "idle rotor". In particular preferably the rotating part 13 can be locked in rotation only in a particular predetermined position, that is arranged for allowing the opening of the tool-holder support during the non-operative steps of the cleaning device.

As shall be described in greater detail in the rest of the description, the actuation system that actuates the cleaning tool 170 of the cleaning device 800' can comprise for example the aforementioned pulling means 4, and/or possibly the thrust means arranged for making the rotary table 3 and the drilling tool 6 slide along the guides 5 of the tower 2, or in any case arranged for lifting and levering the rotary table 3 and the tool 6, including their relative motors, actuators and cables.

Again with reference to FIG. 12 it can be seen that in this case the jaws 11,11' of the tool-holder support can each comprise a distinct first part 11A,11A' and a distinct second part 11B,11B', but these parts always remain engaged during the operative steps of the cleaning device and are disengaged only during disassembling or transfer of the device onto another machine. The parts 11B,11B' are hinged to the tower 2 in a fixed position, so that the tool is always kept at a fixed height on the tower. Like in the previous cases, when said parts are engaged with one another they behave like two integral bodies and the tool-holder support can reversible pass from a closed configuration to an open configuration through actuators 10. As visible in FIG. 13, the static parts 11B,11B' can be provide with cavities 113 in which the arms 11A,11A' can be inserted making a prism-shaped coupling. Once, the parts 11A,11A' have been inserted in the cavities they can be made integral with the parts 11B,11B' for example through the insertion of pins that pass through appropriate seats 114,115 obtained both on the parts 11A, 11A' and on those 11B,11B'.

FIGS. 14 and 15, show a detail of the members for sliding between the fixed part 11B,11B' and one of the mobile parts, also called rotating parts, 13,13'. Such mobile parts 13, 13' can be for example two. Each rotating part 13, 13' can be housed inside the static part 11B,11B'. The rotating part 13 can carry the cleaning tool 170. Each rotating part 13,13' can have an overall substantially semicircular shape, if seen in a direction that is parallel to the axis of the auger 6, and preferably have cross sections such as to preferably form an internal C-shaped channel with the opening facing the static part. Through this channel, the rotating part 13,13' is guided in rotation on the rollers 116 that are fixed partially on one and partially on the other static part through a relative roller support 117, 117'. This C shape can create inside the channel, both above and below, an inner inclined track and an outer inclined track on which the rollers can roll. Since each rotating part 13,13' is connected to the static part only through rollers, it is free to rotate around the axis of the auger 20, or rather it is "idle" in rotation. The roller support can for example be screwed on the static part. This roller support can also have a semicircular shape and be equipped with arms for fixing the rollers shaped so that the rollers are alternately arranged in inclined pairs so as to either couple with the inner or with the outer track.

Considering two pairs of adjacent rollers, it is possible to say that they take up an X-shaped arrangement, which ensures a greater stability of the rotating part since the rollers can react to axial loads in the direction of the drilling axis, to radial loads and to flexing moments. In other embodiments, the inner channel of the rotating part can have an overall different shape or different cross sections and the arrangement of the rollers may not be inclined. In further embodiments the rollers 116 can be integral with the rotating part 13 and the rolling tracks of the rollers could be obtained on the static part 11B,11B'. In the cleaning device 800' the perimetral walls 86A and 86B face inwards with respect to the pass-through opening 82 and preferably do not rotate, since they are rigidly constrained, for example through screws to the static parts 11B,11B'. It is in any case possible, in a constructive variant, to make the perimetral walls integral with the rotor 13 and release in rotation said walls with respect to the static part 11B,11B'. In order to allow the tool-holder support to pass to the open configuration, the cleaner 800' can be provided with a hydraulic locking and safety system that is completely similar to the device 22 that has already been described, that stops in a precise, safe and predetermined position, the semi-circular rotating part 13,13' with respect to the static portion 11B,11B'

We shall now describe a possible embodiment of the operation of the drilling machine 1 and of the relative cleaner 8.

The drilling machine 1 moves centering the drilling point or rather until it centers the bit of the auger 7 with the precise point corresponding to the axis of the pile. The cleaner 8-8' is locked around the auger with the purpose of limiting the radial oscillations, therefore it is closed in an operative position in which it carries out its first function that is that of guiding (FIG. 2A). Preferably, the cleaner is divided into at least two parts or rather jaws 11, 11' which, during the transit on the irregular surface of the construction site are preferably locked open, for example by means of safety lock bolts 18-18*a*. The racks 14, 14' can be fixed to the static part 11 through pinion locking systems 12-12' and/or through an optional anti-rotation safety pin 22*a*—one for each half 11, 11' of the cleaner—which is inserted in the cavity 13*f* of the rotating part 13 or again through hydraulic or electric braking or locking (FIG. 5B).

The drilling machine 1 thus rests the bit 7 of the auger 6 on the ground.

The safety pin 22*a* is retracted—manually or automatically—from the cavity 13*f* of the rotating part 13, and allows the motor 12 to unblock the pinion 12*a* so as to move the semi-circular racks 14-14' (FIG. 5A) in a circular manner around the axis of the auger 20. The cables 4 of the winch are released allowing the rotary table 3 to drop along the guides 5 of the tower 2. When it is arranged, a cable or cylinder actuation means exerts a thrust on the rotary 3 so as to forcefully insert the auger 6 in the ground.

The auger 6 generally on the right, penetrates the ground in a clockwise direction. The cleaner 8-8' preferably stopped on the vertical axis with respect to the auger 6 carries out with its rotating part 13, revolutions in the same rotation direction and preferably at the same rotation speed as the auger 6, and the frequently of the revolutions is proportional to the forward movement and rotation speed of the auger so as to remain fixed at the same height. In this step, the static part 11 passed through by the auger 6, possibly through the reductions 19 when required, acts as a guide for promoting the verticality of the hole. The motorising part of the cleaner 8-8' in this step can be made idle or be rotated in a direction such as to facilitate the penetration.

After for example some meters, following a command of the worker or automatically if the value is preset and managed by the control unit, the pin 22*a* pushed by the cylinder 22 against the convex part of the rotating element 13 encounters the cavity 13*f* located on the track 13*e* and is jammed there, locking the semi-circular rack 14 in the exact point with respect to the static part 11 which makes it possible, without interferences, for the cleaner to be opened in two halves. A simultaneous and identical manoeuvre is carried out in the other half of the cleaner 22*a*' 22' 13' 13*f* etc. As an alternative, the presence of a proximity sensor or of an encoder, or the encoder on the motorisation unit can determine the correct reciprocal position between the rotating part 13 and static part 11 thus sending an enabling signal for the following manoeuvre. In this case the presence of the pin 22*a* is not limiting or necessary.

A hydraulic sequence, triggered by the locked position of the pin 22*a* in the cavity 13*f* or by the activation signal of the sensor, stops the pinion 12*a* and brakes the reducer 12 with the purpose of locking with a further safety, the semicircular rack 14 on the static part 11.

The same sequence allows the cylinder 18*a* to be opened that commands the unlocking of the lock bolt 18, if present for the purpose of additional safety. The two static parts 11-11' are no longer constrained with respect to one another and acting on the cylinders 10-10'—or manually—it is possible to open the cleaner 8-8' in two parts. Each static part, pulls behind it its own rotating part, constrained to it for example through at least one pinion 12*a* braked on the semicircular rack 14 and if present through the pin 22*a* driven into the cavity 13*f* or a braking or abutment system.

The machine 1 carries out the drilling step, the rotary table 3 is capable of passing the two parts 11, 11', which are now open in non operative conditions, of the cleaner 8-8' and of transiting very close to the natural surface line, so as to exploit in an optimal manner the length of the tower 2, in researching the maximum depth of the pile (FIGS. 2B, 7).

When the end of the pile has been reached it is possible to begin the casting step with the pumping of concrete through the inner tube 6A of the auger 6. The auger is normally made to rise avoiding any rotation movement, which can make part of the mass of debris, with which the auger is full, to slide downwards. When present, the rotation is mostly clockwise if the auger is right-handed, so as to promote the rising of the materials and avoid their falling back in the cast that has just been made, but thus complicating the cleaning.

As soon as the rotary table 3 has transited, rising back, in front of the two open parts 11, 11' of the cleaner 8-8', it is possible to carry out the sequence described above in reverse, with the purpose of closing the cleaner 8-8' around the turns, in an operative condition, this time for cleaning. After having been axially referred to through possibly present additional centering devices, the closure of the two mobile parts with the already indicated devices is ensured, for example blocking their closure in a safe and unequivocal manner through the jack 18*a* that acts on the lock bolt 18, or acting on the plants for controlling the actuators 10-10'. The two mobile parts 11, 11' are thus ready to activate the cleaning rotation. In order to promote the insertion manoeuvre, the control unit actuates a partial rotation of the auger such as to allow the entry of the cleaning tool 170 in the recess between two following turns of the thread 60. In order to do this, preferably the axial position of the rotary table 3, the angular position of the auger 6 and the axial position of the cleaner 8 along the tower 2 are constantly monitored with suitable positioning sensors (not shown).

When the at least one roller 17 possibly together with its plough 17*a* has been inserted between two turns or better above the turns, even in the middle of the mass of debris deposited around the core of the auger 6A,—if present—the pin 22*a* is unblocked from the cavity 13*f* and the confirmation is given to the motorization present, for example to the pinion 12A so set the semicircular rack 14 in rotation around the axis 20 of the auger 6 (FIGS. 5A, 2A) or the rotating part 31 actuated by at least one permanent magnet motor 34-35. With a rotation speed driven as a function of the raising speed of the auger 6 and of the possible rotation thereof, the cleaner 8-8' rotates in a clockwise direction with the roller 17 that is substantially in contact with the upper face of the turn of the auger (FIG. 2A, 6B). If present, the spring 21 inserted in the roller support 171 ensures a certain flexibility between the position of the roller and that of the turn. The plough 17*a* removes the debris or more in general the material present on the turns, which is thrown to the ground, radially with respect to the disc of the auger. During the entire rising manoeuvre, the auger 6 may not be subjected to any rotation on its axis.

The operation of the auger cleaner 8' is analogous to that of the cleaner 8, of course mutatis mutandis.

We shall now describe an example of the operation of the cleaning device 800 in the operative cleaning step of the auger. In said step the cleaner 800 can start from an initial configuration, in which: the tool holder support is closed, its static parts 11B,11B' are engaged on parts 11A,11A' of the jaws and rested on them, the trolleys 110 are coupled with the guides of the tower, the drilling tool 6 extends inside the pass-through opening 82, the cleaning tool is engaged with the screw of the tool 6 and the actuators 12,12',12" are braked. Subsequently by carrying out an axial rising movement of the drilling tool 6 without rotating it, it occurs that the cleaning tool 170 enters in abutment with a turn of the auger and, not being able to rotate around the auger since it is braked, it pulls the static parts 11B,11B' of the tool holder support upwards making them slide on the tower. The same pulling effect can be obtained by making the drilling tool 6 rotate in the clockwise direction, so that the turns rise back along the auger, without making it translate axially. Following this upward pulling, the parts 11B,11B' disengage from the parts 11A,11A' of the jaws and remain constrained only to the tower 2 through the trolleys 110. Two locking devices 18, of the type already described, can be present in a position that is diametrically opposite on the parts 11B,11B' so as to ensure the reciprocal closure between the two halves of the cleaner and for keeping it also when they are disengaged from the parts 11A,11A'. At this point it is possible to activate the geared motors 12—or other actuators 12,12', 12"—so as to make the cleaning tool 170 rotate around the drilling tool 6 whereas the latter is stopped. In this way the cleaning tool goes down along the slope of the turns of the auger cleaning them and at the same time the static parts 11B,11B' slide downwards along the tower 2 until they engage in the parts 11A,11A' again.

We shall now describe an operation example of the cleaning device 800' in the operative cleaning step. In said step the cleaner 800' can start from an initial configuration in which: the tool holder support is closed, its static parts 11B,11B' are engaged and integral with the parts 11A,11A' of the jaws, the drilling tool 6 extends inside the pass-through opening 82, the cleaning tool is engaged with the screw of the drilling tool and the rotating part 13 is in the "idle" condition free to rotate around the drilling axis 20. Subsequently, an upward axial movement of the drilling tool 6 is carried out, actuated by the pulling means 4 indirectly connected to the drilling group through the rotary table 3, or connected directly to the auger 6. Also without rotating the drilling tool 6, the effect of the pull is that of actuating the cleaning tool 170 by making it rotate around the drilling axis 20. Following such a rising, the cleaning tool comes into contact with a turn of the auger 6 and, not being able to translate upwards since the cleaner is axially constrained to the tower, it tends to drop along the inclined plane of the auger tool 6, rotating around the axis of the auger itself. More in detail, when the turn of the auger comes into contact with the roller of the cleaning tool, it transmits a part of the force of the pulling means 4 to the roller. Due to the fact that the turn of the auger is inclined with respect to the horizontal, this force can be separated into a component that is parallel to the inclined plane of the auger that pushes the roller in the tangential direction (in the direction of the descent, when pulled—the opposite occurs when pushed) and a component perpendicular with respect to the inclined plane of the auger, which is absorbed by the axial constraint between the cleaner and the tower 2, which in this version is kept locked. The roller and all the cleaning tool 170 thus tend to rotate around the axis of the auger being actuated by the same actuators that drive the translation of the auger. During this rotation around the axis 20, the roller of the cleaning tool (and the cleaner itself) remains at a height that is substantially unvaried on the tower 2 and rolls on the inclined plane of the turns cleaning them as they rise with respect to the tower passing through the pass-through opening 82.

In the case in which the auger is made to rotate at a constant height, i.e. without translating in the direction of the axis of the tower, and the tool-holder support is in the closed configuration it occurs that the cleaning tool rotates integrally with the auger without carrying out the cleaning of the turns. Indeed, in this condition, following the rotation of the auger the roller comes into contact with a turn and, since it is free to rotate around the axis 20, it does not tend to rise back along the turns but is pulled in rotation. In such a case the cleaning tool remains rested again on the same turn without travelling the various steps of the auger and therefore it does not carry out the cleaning. The rotation of the auger is in any case allowed even when the tool-holder support is in the closed condition.

With the lowering of the auger 6 in the drilling step or the downward thrust, there is a reverse rotation of the cleaning tool 170, which rests and abuts against the lower part of the helical turn.

From the previous description it is clear how a cleaning device 8, 8', 800, 800' according to the present invention is capable of increasing the useful depth of the pile and at the same time is capable of cleaning the auger without it rotating with respect to the ground and to the tower 2. A cleaner 8, 8', 800, 800' according to the invention can carry out the function not only of cleaning the drilling screw 6 of the debris caused by drilling, but also of driving and maintaining the drilling screw in the correct position. Thanks to its shape, the cleaner according to the invention acts in an advantageous manner between the turns of the augers, being guided on the other hand outside them. The system is "centered" on the axis of the auger so as to not trigger tension on the guiding tower 2. In the open configuration, since the cleaning tool 170 can move away and disengage from the helical drilling tool 6, a cleaner according to the invention produces a lot less friction and resistance to the rotation of the auger 6, i.e. for most of the drilling stroke of the auger, which is the drilling step in which the rotary table 3 must dispense the maximum driving torque; therefore, for the same resistant torque applied to the auger 6 from the ground to be drilled, a cleaner according to the invention makes it possible to adopt rotary tables that are less powerful. Moreover, again since in the open configuration the cleaning tool 170 can move away and disengage from the helical drilling tool 6, a cleaner according to the invention minimises the wearing of the drilling auger 6 and of the guides along which the possible slide or shoe 90 or trolley 110 slides that allows the cleaner 8, 8',800,800' to slide along the guiding tower 2.

Even with the previously mentioned advantages, the cleaner object of the present innovation can be separated into at least two parts 11 and 11' so as to not represent obstacle to the downward transit of the rotary table 3, so as to increase the drilling depth. The cleaner can be mounted at any height of the tower, preferably at a few meters from the ground, so as to limit the height of fall of the debris and at the same time so as to allow debris to be removed easily through a mechanical blade that acts near to or below the cleaning tool 170.

In the case in which the cleaning device can slide on the tower, for example in the constructive embodiment 800, it is advantageous that there is no need for position sensors for keeping the synchronism between the revolution frequency of the cleaning tool and the forward movement and rotation speed of the auger. It is not necessary to monitor with control systems the axial position of the rotary table 3, the angular position of the auger 6 and the axial position of the cleaner 8 on the tower. Indeed, in this case, the tool-holder support spontaneously, and purely in a mechanical manner, modifies its axial position on the tower to compensate for the lack of synchronism.

Also the embodiment 800' does not require the use of position sensors in order to maintain the synchronism of the cleaning tool since the rotating part, thanks to the fact that it is "idle", spontaneously and in a purely mechanical manner, adapts its revolution frequency around the axis 20 of the auger.

The embodiment 800' also has the advantage of being constructively more simple since it does not require the presence of the rack 14, of the pinions 12*a* or of the motors 12, 12' on the cleaner. Also the hydraulic plant is simplified since it is no longer necessary to supply the motors 12,12'.

The embodiment 800' in which the jaws 11,11' can be separated into two parts 11A,11A' and 11B,11B' provides a further advantage if it is desired to transfer the device 800' from one machine 1 to another machine 1' that has a different spacing between the drilling axis and the guides 5 of the tower. In such a case it is sufficient to replace the parts 11A,11A' with new parts with different length and that are suitable for the new spacing, whereas it is possible to reuse the entire part 11B,11B' without any modification.

In the case of CSP technology (cased auger with double rotary, one for setting the auger in rotation and the other, the one arranged below the first one, for setting in rotation the case outside the auger) the cleaner is capable of cleaning the entire auger extracted from the tube in an extremely effective manner. At the same time, in the drilling step the two rotary tables can proceed in contact with one another, increasing the depth of the cased part of the hole for the same length of the tower.

Moreover, it is possible to increase the drilling depth by using a cantilevered rod, passing on the rotary table 3 (not indicated in the figure). In this case with a method of "re-working" the rotary table 3 hooks from above the cantilevered rod at the end of the first drilling step for further increasing the depth. At the end, during the casting and rising steps, as soon as the rotary table 3 has transited beyond the cleaner 8-8'-800-800', it is possible to close its parts that can be opened 11,11' until the cleaner element 170 comes near the rod, which is functionally identical to the core of the auger 6A. The rotation movements promote the cleaning of the rod and in the moment in which the auger 6 comes out from the ground and reaches the cleaning element 170, the conditions previously described are re-obtained.

The embodiments previously described can undergo numerous modification and variants without for this reason departing from the scope of protection of the present invention. For example the jaws 11, 11' and/or the rotors 13, 13' can be reversibly opened and closed not only by making them rotate, but also by making them translate or rotate and simultaneously translate, and not only through linear actuators 10, 10' but also through rotary actuators or motors. The jaws 11, 11' and/or the rotors 13, 13' can also be open and closed manually instead of by means of the actuators 10, 10'. The cleaning tool can extend not only inside, but also outside of the pass-through opening 82. The tool-holder support can also comprise more than two jaws 11, 11' or rotors that can be reversibly opened. The rotors 13, 13' can also extend outside from the respective fixed part 11A, 11B. In the case in which there is a single rotor—for example 13—or a single rotating perimetral wall 86A, it is possible to locate three actuators—analogous to the actuators 12, 12',12"—arranged 120° apart from one another, two on a first jaw 11 and one on a second, so that during the rotation, the rotor 13, having an angular extension that is greater than 120° and lower than or equal to 180° can always be engaged with at least one actuator and when the jaw has to be opened, it can face the static part with a precise angular reference and such as to be able to allow it to be opened without any impediment or interference with the corresponding other jaw.

Moreover, all the details can be replaced by technically equivalent elements. For example the materials used, as well as the dimensions, can be any according to the technical requirements. It should be understood that an expression of the type "A comprises B, C, D" or "A is formed by B, C, D" comprises and describes also the particular case in which "A is made up of B, C, D". The examples and lists of possible variants of the present application should be taken as non exhaustive lists.

The invention claimed is:

1. An auger cleaning device for removing debris from a helical drilling tool provided with one or more threads and arranged for drilling ground, the cleaning device comprising:

a tool-holder support;

at least one cleaning tool constrained to the tool-holder support;

an actuation system, wherein the cleaning tool is arranged for being actuated by the actuation system and the tool-holder support is arranged for reversibly passing from an open configuration to a closed configuration so that:

in the closed configuration the tool-holder support forms a pass-through opening arranged for allowing the passage of the helical drilling tool, the cleaning tool engaging with the one or more threads of the drilling tool and the cleaning tool is arranged for rotating around a longitudinal axis of the drilling tool running along at least one of the one or more threads so as to remove the debris lying on the drilling tool, said cleaning tool being actuated by the actuation system; and in the open configuration the cleaning tool is disengaged from the drilling tool and is disposed farther from the drilling tool in the open configuration than in the closed configuration, and wherein the tool-holder support comprises a first jaw and a second jaw arranged for reversibly opening and closing between the open configuration and the closed configuration of the tool-holder support, each of the first jaw and the second jaw comprising a static part and a rotating part mounted inside the static part, said rotating parts being rotatable about the longitudinal axis of the drilling tool when the first jaw and the second jaw are in the closed configuration; and a locking safety system arranged for locking the rotating parts in a precise position with respect to the static parts enabling the opening of the first jaw and the second jaw from the closed configuration to the open configuration of the tool-holder support when the rotating parts face the corresponding static parts and are completely contained in the corresponding static parts.

2. The cleaning device according to claim 1, wherein:

the pass-through opening is bounded by one or more perimetral walls, each of which faces the inside of the pass-through opening itself;

in the open configuration the one or more perimetral walls are disposed further away from the helical drilling tool than in the closed configuration.

3. The cleaning device according to claim 1, wherein:

the helical drilling tool is fixed to a rotary table arranged for rotating the drilling tool around the longitudinal axis of the drilling tool and having overall dimensions such as to not be able to pass through the pass-through opening of the tool-holder support in the closed configuration;

in the open configuration, the tool-holder support is arranged for allowing at least a part of the rotary table to pass through the tool-holder support.

4. The cleaning device according to claim 1, wherein the tool-holder support comprises:

a first perimetral wall forming a first concave seat; and a second perimetral wall forming a second concave seat, wherein the first and the second concave seat:

are each arranged for receiving a part of the sides of the one or more threads of the drilling tool extending around at least a part of a perimeter of the cross sections of the one or more threads; and are arranged for being reversibly opened and closed allowing the tool-holder support to pass from the closed configuration to the open configuration.

5. The cleaning device according to claim 4, wherein, when the first perimetral wall and the second perimetral wall are closed and driven by the actuation system, they are arranged for rotating around the longitudinal axis of the helical drilling tool with the rotating parts.

6. The cleaning device according to claim 4, wherein the first perimetral wall is constrained to the first jaw and the second perimetral wall is constrained to the second jaw.

7. The cleaning device according to claim 5, wherein the tool actuation system comprises at least a first pinion, a first rack sector, and a second rack sector, said at least a first pinion being engaged with the first rack sector or with the second rack sector and arranged for allowing the cleaning tool to effect rotations equal to or greater than a complete turn around the longitudinal axis of the drilling tool.

8. The cleaning device according to claim 7, wherein the tool actuation system includes at least one actuator with a hydraulic motor arranged for driving the at least a first pinion so as to cause the cleaning tool to effect rotations equal to or greater than a complete turn around the longitudinal axis of the drilling tool.

9. The cleaning device according to claim 7, wherein, when the first perimetral wall and the second perimetral wall are closed, the first rack sector and the second rack sector form a complete circular rack.

10. The cleaning device according to claim 4, wherein said rotating parts include the first perimetral wall and the second perimetral wall, and said locking safety system enables the opening of the first jaw and the second jaw when the first perimetral wall and the second perimetral wall at least one of face the corresponding static parts and are completely contained in the corresponding static parts.

11. The cleaning device according to claim 1, comprising:

a sliding guide in turn comprising a track and a shoe or another slider arranged for sliding with respect to the track;

and wherein:

the cleaning tool is mounted on the shoe or the another slider;

in the closed configuration at least one of the track and the shoe or the another slider substantially form a ring allowing the cleaning tool to rotate around the helical drilling tool, sliding with respect to the track and describing at least one complete rotation around the helical drilling tool;

in the open configuration at least one of the track and the shoe or the another slider are separated into at least two portions substantially having the overall shape of an arc of a circle.

12. A drilling machine for drilling or excavating ground, comprising:

a guiding tower;

a helical drilling tool provided with one or more threads arranged for drilling or in any case excavating a ground;

a rotary table by which the helical drilling tool is suspended from the guiding tower, the rotary table being arranged for rotating the helical drilling tool around a longitudinal axis of the helical drilling tool;

an auger cleaning device according to claim 1, arranged for guiding the helical drilling tool and removing the debris deposited on the drilling tool during drilling.

13. The machine according to claim 12, wherein the auger cleaning device is either in a permanently fixed position with respect to the guiding tower and integral with the guiding tower, or displaceable along the guiding tower during the normal use of the machine.

14. Use of a drilling machine having the features according to claim 12, comprising:

an initial drilling step in which the auger cleaner is closed for guiding the helical drilling tool, and a second step in which the rotary table and the helical drilling tool fixed to it during the drilling step at least partially pass through the open tool-holder support, while the rotary table and the tool are reversibly lowered and raised along the guiding tower.

15. Use of a drilling machine having the features according to claim 12, wherein the use comprises:

lifting the drilling tool allowing the screw to pass through the pass-through opening while the tool-holder support is closed, and cleaning the one or more threads of the helical drilling tool of debris by the at least one cleaning tool during the step of lifting.

* * * * *